US011212631B2

(12) United States Patent
Chon et al.

(10) Patent No.: US 11,212,631 B2
(45) Date of Patent: Dec. 28, 2021

(54) METHOD FOR GENERATING BINAURAL SIGNALS FROM STEREO SIGNALS USING UPMIXING BINAURALIZATION, AND APPARATUS THEREFOR

(71) Applicant: GAUDIO LAB, INC., Seoul (KR)

(72) Inventors: Sangbae Chon, Seoul (KR); Byoungjoon Ahn, Gyeonggi-do (KR); Jaesung Choi, Seoul (KR); Hyunoh Oh, Gyeonggi-do (KR); Jeonghun Seo, Seoul (KR); Taegyu Lee, Seoul (KR)

(73) Assignee: GAUDIO LAB, INC., Seoul (KR)

( * ) Notice: Subject to any disclaimer, the term of this patent is extended or adjusted under 35 U.S.C. 154(b) by 0 days.

(21) Appl. No.: 17/022,065

(22) Filed: Sep. 15, 2020

(65) Prior Publication Data

US 2021/0084424 A1 Mar. 18, 2021

(30) Foreign Application Priority Data

Sep. 16, 2019 (KR) ..... 10-2019-0113428
Oct. 7, 2019 (KR) ..... 10-2019-0123839

(51) Int. Cl.
*H04S 1/00* (2006.01)
*H04S 7/00* (2006.01)
*H04S 5/00* (2006.01)

(52) U.S. Cl.
CPC ..... *H04S 1/002* (2013.01); *H04S 1/007* (2013.01); *H04S 7/30* (2013.01); *H04S 2420/01* (2013.01)

(58) Field of Classification Search
None
See application file for complete search history.

(56) References Cited

U.S. PATENT DOCUMENTS 8,989,881 B2 * 3/2015 Popp ..... G11B 27/3063 700/94
2007/0160219 A1 7/2007 Jakka et al.
(Continued)

FOREIGN PATENT DOCUMENTS

CN 101366321 2/2009
CN 107005778 8/2017
(Continued)

OTHER PUBLICATIONS

Office Action dated Sep. 3, 2021 for Chinese Patent Application No. 202010972423.5 and its English translation provided by Applicant's foreign counsel.
(Continued)

*Primary Examiner* — Qin Zhu
(74) *Attorney, Agent, or Firm* — Ladas & Parry, LLP

(57) ABSTRACT

Disclosed is an audio signal processing method including: receiving a stereo signal; transforming the stereo signal into a frequency-domain signal; rendering the first signal based on a first ipsilateral filter coefficient; generating a frontal ipsilateral signal relating to the frequency-domain signal; rendering the second signal based on a second ipsilateral filter coefficient; generating a side ipsilateral signal relating to the frequency-domain signal; rendering the second signal based on a contralateral filter coefficient; generating a side contralateral signal relating to the frequency-domain signal; transforming an ipsilateral signal, generated by mixing the frontal ipsilateral signal and the side ipsilateral signal, and the side contralateral signal into a time-domain ipsilateral signal and a time-domain contralateral signal, which are time-domain signals, respectively; and generating a binaural signal by mixing the time-domain ipsilateral signal and the time-domain contralateral signal.

16 Claims, 26 Drawing Sheets

(56) References Cited

U.S. PATENT DOCUMENTS

| | | | | |
|---|---|---|---|---|
| 2009/0129601 | A1* | 5/2009 | Ojala | G10L 19/008 381/1 |
| 2009/0252338 | A1* | 10/2009 | Koppens | H04S 7/00 381/17 |
| 2009/0313028 | A1* | 12/2009 | Tammi | H04S 1/007 704/500 |
| 2012/0163606 | A1* | 6/2012 | Eronen | H04S 7/302 381/22 |
| 2012/0201389 | A1* | 8/2012 | Emerit | H04S 1/002 381/23 |
| 2015/0049872 | A1* | 2/2015 | Virette | G10L 19/008 381/23 |
| 2016/0044432 | A1* | 2/2016 | Grosche | H04S 7/308 381/17 |
| 2017/0245055 | A1* | 8/2017 | Sun | H04R 5/04 |
| 2019/0200159 | A1 | 6/2019 | Park et al. | |

FOREIGN PATENT DOCUMENTS

| | | |
|---|---|---|
| CN | 108293165 | 7/2018 |
| CN | 110035376 | 7/2019 |
| JP | 2019-115042 | 7/2019 |
| WO | 2017/223110 | 12/2017 |

OTHER PUBLICATIONS

Xiaoping Xu et al.: "Modulation Spliced Transform Binaural Cue Coding Algorithm-based Encoder", MATEC Web Conference, Electronic Information and Control Engineering, Beijing University of Technology, China, Dec. 31, 2016. See pp. 1-3.

Office Action dated Oct. 11, 2021 for Japanese Patent Application No. 2020-155423 and its English translation provided by Applicant's foreign counsel.

* cited by examiner

【Figure】

METHOD FOR GENERATING BINAURAL SIGNALS FROM STEREO SIGNALS USING UPMIXING BINAURALIZATION, AND APPARATUS THEREFOR

CROSS-REFERENCE TO RELATED APPLICATIONS

This application claims priority to and the benefit of Korean Patent Application No. 10-2019-0113428 filed in the Korean Intellectual Property Office on Sep. 16, 2019, and Korean Patent Application No. 10-2019-0123839 filed in the Korean Intellectual Property Office on Oct. 7, 2019, the entire contents of which are incorporated herein by reference.

TECHNICAL FIELD

The present disclosure relates to a signal processing method and apparatus for effectively transmitting and reproducing an audio signal, and more particularly to an audio signal processing method and apparatus for providing an audio signal having an improved spatial sense to a user using media services that include audio, such as broadcasting and streaming.

BACKGROUND ART

After the advent of multi-channel audio formats such as 5.1 channel audio, contents that provide more immersive and realistic sound through multi-channel audio signals are becoming recognized as mainstream media in the media market. Already in theaters, contents and reproduction systems in the form of Dolby Atmos, which uses objects, beyond the conventional 5.1-channel-based sound system are frequently found. Furthermore, in the field of home appliances also, virtual 3D rendering that provides original multi-channel content sound using a device having a limited form factor, such as a soundbar or a UHDTV, is used to provide a more immersive and realistic sound, beyond the faithful sound reproduction of multi-channel contents by conventional DVD or Blu-ray Disc using a device such as a home theater system.

Nevertheless, contents are consumed most frequently in personal devices such as smartphones and tablets. In this case, sound is usually transmitted in a stereo format and output through earphones and headphones, and therefore, it becomes difficult to provide sufficient immersive sound. In order to overcome this problem, an upmixer and a binaural renderer can be used.

The upmixing mainly uses a structure of synthesizing signals through analysis thereof, and has an overlap-and-add processing structure based on windowing and time-frequency transform, which guarantee perfect reconstruction.

The binaural rendering is implemented by performing convolution of a head-related impulse response (HRIR) of a given virtual channel. Therefore, the binaural rendering requires a relatively large amount of computation, and thus has a structure in which a signal time-frequency transformed after being zero-padded is multiplied in a frequency domain. Also, when a very-long HRIR is required, the binaural rendering may employ block convolution.

Both the upmixing and the binaural rendering are performed in frequency domains. However, the two frequency domains have different characteristics. The upmixing is characterized in that a signal change thereof in the frequency domain generally shows no phase change, since a phase change is incompatible with the assumption of perfect reconstruction by an analysis window and a synthesis window. The frequency domain of the binaural rendering is restrictive in that a circular convolution domain including a phase change or a signal and an HRR for convolution are zero-padded and thus aliasing by circular convolution should not occur. This is because the change in the input signal by the upmixing does not guarantee a zero-padded area.

In a case where two processes are combined in serial, all the time-frequency transforms for upmixing should be included, and thus a very-large amount of computation is required. Therefore, a technique that can reflect both of the two structures and is optimized in terms of computational amount is required.

DISCLOSURE

Technical Problem

An aspect of the present disclosure is to provide an overlap-and-add processing structure in which upmixing and binaural rendering are efficiently combined.

Another aspect of the present disclosure is to provide a method for using ipsilateral rendering in order to reduce coloration artifacts such as comb filtering that occurs during frontal sound image localization.

Technical Solution

The present specification provides an audio signal processing method.

Specifically, the audio signal processing method includes: receiving a stereo signal; transforming the stereo signal into a frequency-domain signal; separating the signal in the frequency domain into a first signal and a second signal based on an inter-channel correlation and an inter-channel level difference (ICLD) of the frequency-domain signal, wherein the first signal includes a frontal component of the frequency-domain signal, and the second signal includes a side component of the frequency-domain signal; rendering the first signal based on a first ipsilateral filter coefficient, and generating a frontal ipsilateral signal relating to the frequency-domain signal, wherein the first ipsilateral filter coefficient is generated based on an ipsilateral response signal of a first head-related impulse response (HRIR); rendering the second signal based on a second ipsilateral filter coefficient and generating a side ipsilateral signal relating to the frequency-domain signal, wherein the second ipsilateral filter coefficient is generated based on an ipsilateral response signal of a second HRIR; rendering the second signal based on a contralateral filter coefficient, and generating a side contralateral signal relating to the frequency-domain signal, wherein the contralateral filter coefficient is generated based on a contralateral response signal of the second HRIR; transforming an ipsilateral signal, generated by mixing the frontal ipsilateral signal and the side ipsilateral signal, and the side contralateral signal into a time-domain ipsilateral signal and a time-domain contralateral signal, which are time-domain signals, respectively; and generating a binaural signal by mixing the time-domain ipsilateral signal and the time-domain contralateral signal, wherein the binaural signal is generated in consideration of an interaural time delay (ITD) applied to the time-domain contralateral signal, and wherein the first ipsilateral filter coefficient, the second ipsilateral filter coefficient, and the contralateral filter coefficient are real numbers.

Further, in the present specification, an audio signal processing apparatus includes: an input terminal configured to receive a stereo signal; and a processor including a renderer, wherein the processor is configured to: transform the stereo signal into a frequency-domain signal; separate the signal in the frequency domain into a first signal and a second signal based on an inter-channel correlation and an inter-channel level difference (ICLD) of the frequency-domain signal, wherein the first signal includes a frontal component of the frequency-domain signal and the second signal includes a side component of the frequency-domain signal; render the first signal based on a first ipsilateral filter coefficient, and generate a frontal ipsilateral signal relating to the frequency-domain signal, wherein the first ipsilateral filter coefficient is generated based on an ipsilateral response signal of a first head-related impulse response (HRIR); render the second signal based on a second ipsilateral filter coefficient and generate a side ipsilateral signal relating to the frequency-domain signal, wherein the second ipsilateral filter coefficient is generated based on an ipsilateral response signal of a second HRIR; render the second signal based on a contralateral filter coefficient, and generate a side contralateral signal relating to the frequency-domain signal, wherein the contralateral filter coefficient is generated based on a contralateral response signal of the second HRIR; transform an ipsilateral signal, generated by mixing the frontal ipsilateral signal and the side ipsilateral signal, and the side contralateral signal into a time-domain ipsilateral signal and a time-domain contralateral signal, which are time-domain signals, respectively; and generate a binaural signal by mixing the time-domain ipsilateral signal and the time-domain contralateral signal, wherein the binaural signal is generated in consideration of an interaural time delay (ITD) applied to the time-domain contralateral signal, and wherein the first ipsilateral filter coefficient, the second ipsilateral filter coefficient, and the contralateral filter coefficient are real numbers.

Furthermore, in the present specification, the transforming of an ipsilateral signal, generated by mixing the frontal ipsilateral signal and the side ipsilateral signal, and the side contralateral signal into a time-domain ipsilateral signal and a time-domain contralateral signal, which are time-domain signals, respectively, includes: transforming a left ipsilateral signal and a right ipsilateral signal, generated by mixing the frontal ipsilateral signal and the side ipsilateral signal for each of left and right channels, into a time-domain left ipsilateral signal and a time-domain right ipsilateral signal, which are time-domain signals, respectively; and transforming the side contralateral signal into a left-side contralateral signal and a right-side contralateral signal, which are time-domain signals, for each of left and right channels, wherein the binaural signal is generated by mixing the time-domain left ipsilateral signal and a time-domain left-side contralateral signal, and by mixing the time-domain right ipsilateral signal and a time-domain right-side contralateral signal.

Still furthermore, in the present specification, the sum of a left-channel signal of the first signal and a left-channel signal of the second signal is the same as a left-channel signal of the stereo signal.

In addition, in the present specification, the sum of the right-channel signal of the first signal and the right-channel signal of the second signal is the same as the right-channel signal of the stereo signal.

In addition, in the present specification, energy of the left-channel signal of the first signal and energy of the right-channel signal of the first signal are the same.

In addition, in the present specification, a contralateral characteristic of the HRIR in consideration of ITD is applied to an ipsilateral characteristic of the HRIR.

In addition, in the present specification, the ITD is 1 ms or less.

In addition, in the present specification, a phase of the left-channel signal of the first signal is the same as a phase of the left-channel signal of the frontal ipsilateral signal; a phase of the right-channel signal of the first signal is the same as a phase of the right-channel signal of the frontal ipsilateral signal; a phase of the left-channel signal of the second signal, a phase of a left-side signal of the side ipsilateral signal, and the phase of a left-side signal of the contralateral signal are the same; and a phase of a right-channel signal of the second signal, a phase of a right-side signal of the side ipsilateral signal, and a phase of a right-side signal of the side contralateral signal are the same.

Advantageous Effects

The present disclosure provides a sound having an improved spatial sense through upmixing and binauralization based on a stereo sound source.

DESCRIPTION OF DRAWINGS

The above and other aspects, features and advantages of the present disclosure will be more apparent from the following detailed description taken in conjunction with the accompanying drawings, in which.

MODE FOR INVENTION

The following terms used in the present specification have been selected as general terms that are the most widely used at present while considering functions in the present disclosure. However, the meanings of the terms may vary according to the intention of a person skilled in the art, usual practice, or the emergence of new technologies. In addition, in a particular case, there are terms randomly selected by an applicant, and here, the meaning of the terms will be described in the corresponding part in the description of the present disclosure. Therefore, it is noted that terms used in the present specification should be understood based on the substantial meaning of the terms and the overall context of the present specification, not the terms itself.

Upmix Binaural Signal Generation Algorithm

Figure 1:
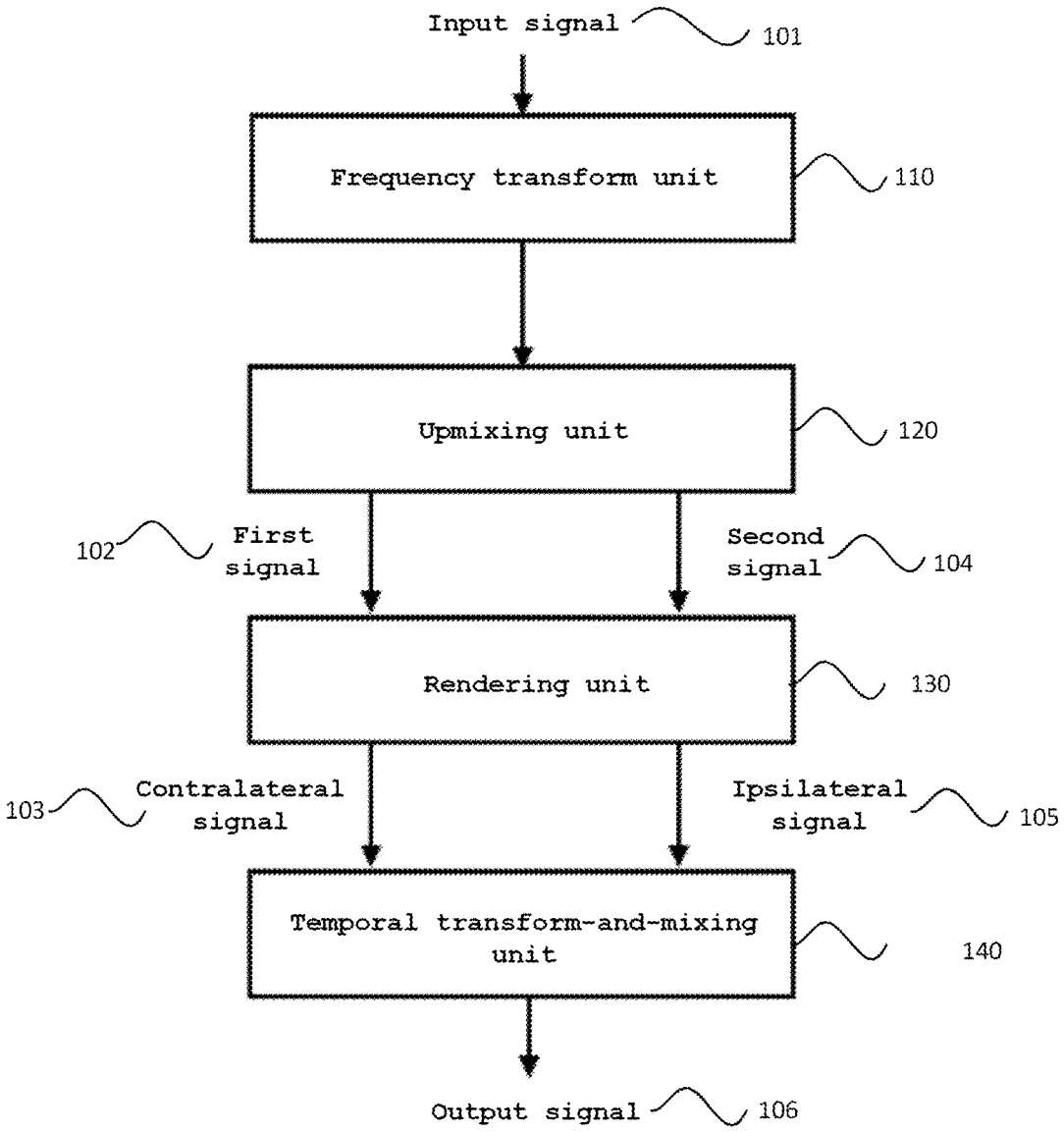
FIG. 1 is a block diagram illustrating an apparatus for generating an upmix binaural signal according to an embodiment of the present disclosure.

FIG. 1 is a block diagram of an apparatus for generating an upmix binaural signal according to an embodiment of the present disclosure.

Referring to FIG. 1, an algorithm for generating an upmix binaural signal will be described. Specifically, an apparatus for generating an upmixed binaural signal may include a frequency transform unit 110, an upmixing unit 120, a rendering unit 130, and a temporal transform-and-mixing unit 140. An apparatus for generating an upmix binaural signal may receive an input signal 101, as an input, and may generate and output a binaural signal, which is an output signal 106. Here, the input signal 101 may be a stereo signal. The frequency transform unit 110 may transform an input signal in a time domain into a frequency-domain signal in order to analyze the input signal 101. The upmixing unit 120 may separate the input signal 101 into a first signal, which is a frontal signal component, and a second signal, which is a side signal component, based on a cross-correlation between channels according to each frequency of the input signal 101 and an inter-channel level difference (ICLD), which indicates an energy ratio between a left channel and a right channel of the input signal 101, through a coherence analysis. The rendering unit 130 may perform filtering based on a head related transfer function (HRTF) corresponding to the separated signal. In addition, the rendering unit 130 may generate an ipsilateral stereo binaural signal and a contralateral stereo binaural signal. The temporal transform-and-mixing unit 140 may transform the ipsilateral stereo binaural signal and the contralateral stereo binaural signal into respective signals in a time domain. The temporal transform-and-mixing unit 140 may synthesize an upmixed binaural signal by applying a sample delay to a transformed contralateral binaural signal component in a time domain and then mixing the transformed contralateral binaural signal component with the ipsilateral binaural signal component. Here, the sample delay may be an interaural time delay (ITD).

Specifically, the frequency transform unit 110 and the temporal transform-and-mixing unit 140 (a temporal transform portion) may include a structure in which an analysis window for providing perfect reconstruction and a synthesis window are paired. For example, a sine window may be used as the analysis window and the synthesis window. Further, for signal transform, a pair of a short-time Fourier transform (SIFT) and an inverse short-time Fourier transform (ISTFT) may be used. A time-domain signal may be transformed into a frequency-domain signal through the frequency transform unit 110. Upmixing and rendering may be performed in the frequency domain. A signal for which upmixing and rendering are performed may be transformed again into a signal in the time domain through the temporal transform-and-mixing unit 140.

The upmixing unit 120 may extract a coherence between left/right signals according to each frequency of the input signal 101. Further, the upmixing unit 120 may determine an overall front-rear ratio based on the ICLD of the input signal 101. In addition, the upmixing unit 120 may separate the input signal 101 (e.g., a stereo signal) into a first signal 102, which is a frontal stereo channel component, and a second signal 104, which is a rear stereo channel component, according to a front-rear ratio. In the present specification, the terms "rear" and "(lateral) side" may be interchangeably used in the description. For example, "rear stereo channel component" may have the same meaning as "side stereo channel component".

The rendering unit 130 may generate a frontal binaural signal by applying a preset frontal spatial filter gain to the first signal 102, which is a frontal stereo channel component. In addition, the rendering unit 130 may generate a rear binaural signal by applying a preset rear spatial filter gain to the second signal 104, which is a rear stereo channel component. For example, when the front is set to 0 degrees, the rendering unit 130 may generate a frontal spatial filter gain based on an ipsilateral component of a head-related impulse response (HRIR) corresponding to a 30-degree azimuth. In addition, the rendering unit 130 may generate a rear spatial filter gain based on ipsilateral and contralateral components of an HRIR corresponding to a 90-degree azimuth, that is, a lateral side.

The frontal spatial filter gain is that the sound image of a signal can be localized in the front, and the rear spatial filter gain is that the left/right widths of the signal can be widened.

Further, the frontal spatial filter gain and the rear spatial filter gain may be configured in the form of a gain without a phase component. The frontal spatial filter gain may be defined by the ipsilateral component only, and the rear spatial filter gain may be defined based on both the ipsilateral and contralateral components.

The ipsilateral signals of the frontal binaural signal and the rear binaural signal generated by the rendering unit 130 may be mixed and output as a final ipsilateral stereo binaural signal 105. The contralateral signal of the rear binaural signal may be output as a contralateral stereo binaural signal 103.

The temporal transform-and-mixing unit 140 may transform the ipsilateral stereo binaural signal 105 and the contralateral stereo binaural signal 103 into respective signals in a time domain, by using a specific transform technique (e.g., inverse short-time Fourier transform). Further, the temporal transform-and-mixing unit 140 may generate an ipsilateral binaural signal in the time domain and a contralateral binaural signal in the time domain by applying synthesis windowing to each of the transformed time-domain signals. In addition, the temporal transform-and-mixing unit 140 may apply a delay to the generated contralateral signal in the time domain and then mix the delayed contralateral signal with the ipsilateral signal in an overlap-and-add form and store the same in the same output buffer. Here, the delay may be an interaural time delay. In addition, the temporal transform-and-mixing unit 140 outputs an output signal 106. Here, the output signal 106 may be an upmixed binaural signal.

Figure 2:
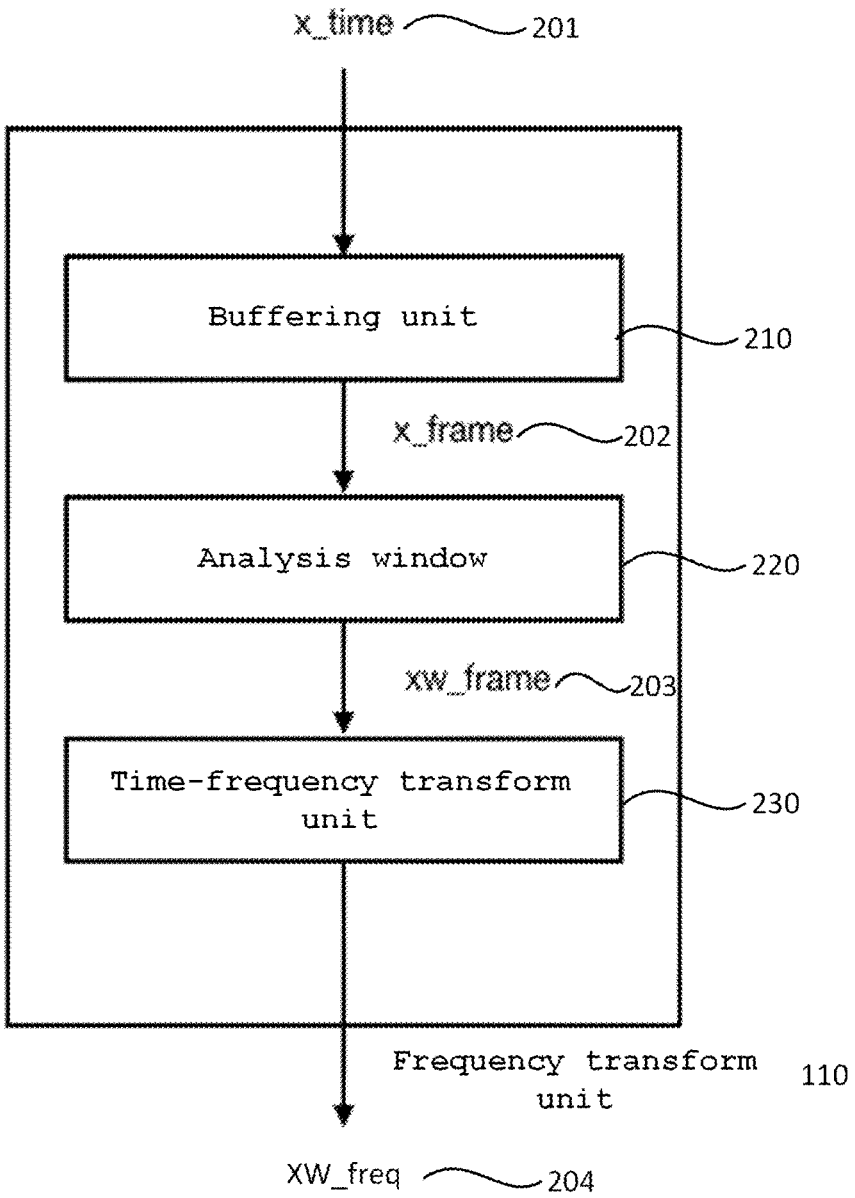
FIG. 2 illustrates a frequency transform unit of an apparatus for generating an upmix binaural signal according to an embodiment of the present disclosure.

FIG. 2 illustrates a frequency transform unit of an apparatus for generating an upmix binaural signal according to an embodiment of the present disclosure.

FIG. 2 specifically illustrates the frequency transform unit 110 of the apparatus for generating a binaural signal, which has been described with reference to FIG. 1. Hereinafter, the frequency transform unit 110 will be described in detail through FIG. 2.

First, the buffering unit 210 receives x_time 201, which is a stereo signal in a time domain. Here, x_time 201 may be the input signal 101 of FIG. 1. The buffering unit 210 may calculate, from the x_time 201, a stereo frame buffer (x_frame) 202 for frame processing through <Equation 1>. Hereinafter, indices "L" and "R" in the present specification denote a left signal and a right signal, respectively. "L" and "R" in <Equation 1> denote a left signal and a right signal of a stereo signal, respectively. "I" of <Equation 1> denotes a frame index. "NH" of <Equation 1> indicates half of the frame length. For example, if 1024 samples configure one frame, "NH" is configured as 512.

$$x_frame[I][L]=x_time[L][(I-1)*NH+1:(I+1)*NH]$$

$$x_frame[I][R]=x_time[R][(I-1)*NH+1:(I+1)*NH] \quad \text{[Equation 1]}$$

According to <Equation 1>, x_frame[l] may be defined as an l-th frame stereo signal, and may have a ½ overlap.

In the analysis window 220, xw_frame 203 may be calculated by multiplying a frame signal (x_frame) 202 by wind, which is preset in the form of a window for providing perfect reconstruction and the length of which is "NF" corresponding to the length of the frame signal, as in <Equation 2>.

$$xw_frame[I][L][n]=x_frame[I][L][n]*wind[n] \text{ for } n=1,2,\ldots,NF$$

$$xw_frame[I][R][n]=x_frame[l][R][n]*wind[n] \text{ for } n=1,2,\ldots,NF \quad \text{[Equation 2]}$$

Figure 3:
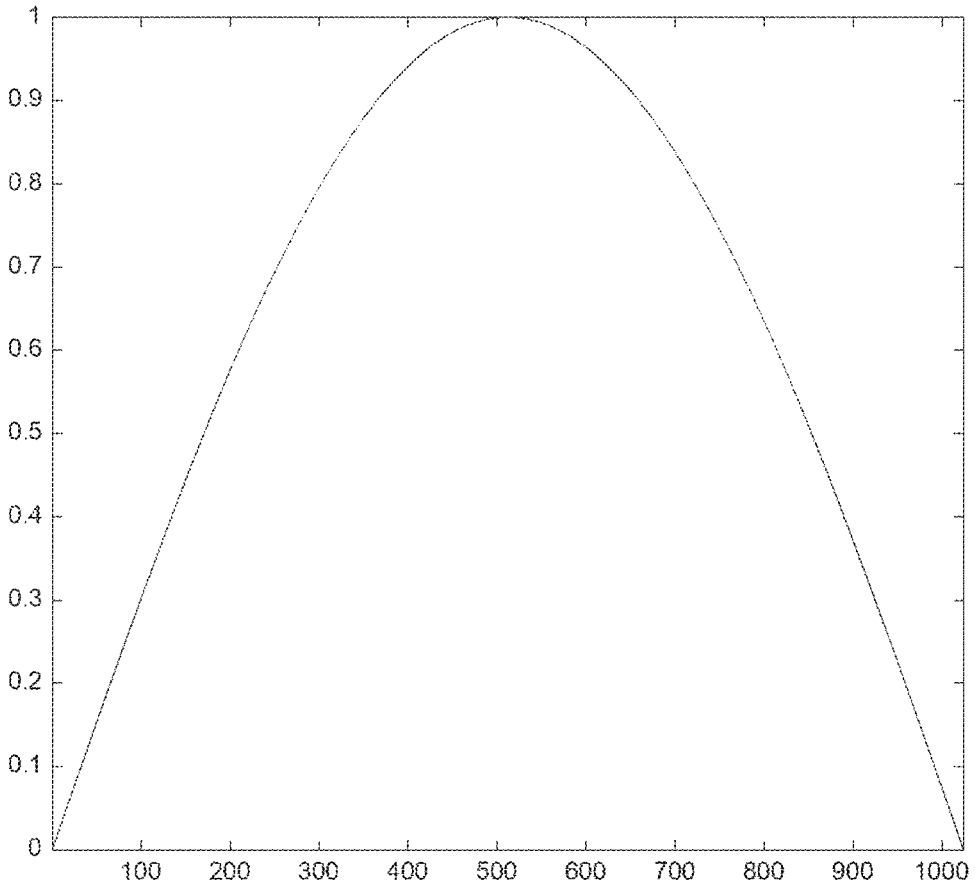
FIG. 3 is a graph showing a sine window for providing perfect reconstruction according to an embodiment of the present disclosure.

FIG. 3 is a graph showing a sine window for providing perfect reconstruction according to an embodiment of the present disclosure. Specifically, FIG. 3 is an example of the preset wind and illustrates a sine window when the "NF" is 1024.

The time-frequency transform unit 230 may obtain a frequency-domain signal by performing time-frequency transform of xw_frame[l] calculated through <Equation 2>. Specifically, the time-frequency transform unit 230 may obtain a frequency-domain signal XW_freq 204 by performing time-frequency transform of xw_frame[l] as in <Equation 3>. DFT { } in <Equation 3> denotes discrete Fourier transform (DFT). DFT is an embodiment of time-frequency transform, and a filter bank or another transform technique as well as the DFT may be used for time-frequency transform.

$$XW_freq[I][L][1:NF]=DFT\{xw_frame[I][L][1:NF]\}$$

$$XW_freq[I][R][1:NF]=DFT\{xw_frame[I][R][1:NF]\} \quad \text{[Equation 3]}$$

Figure 4:
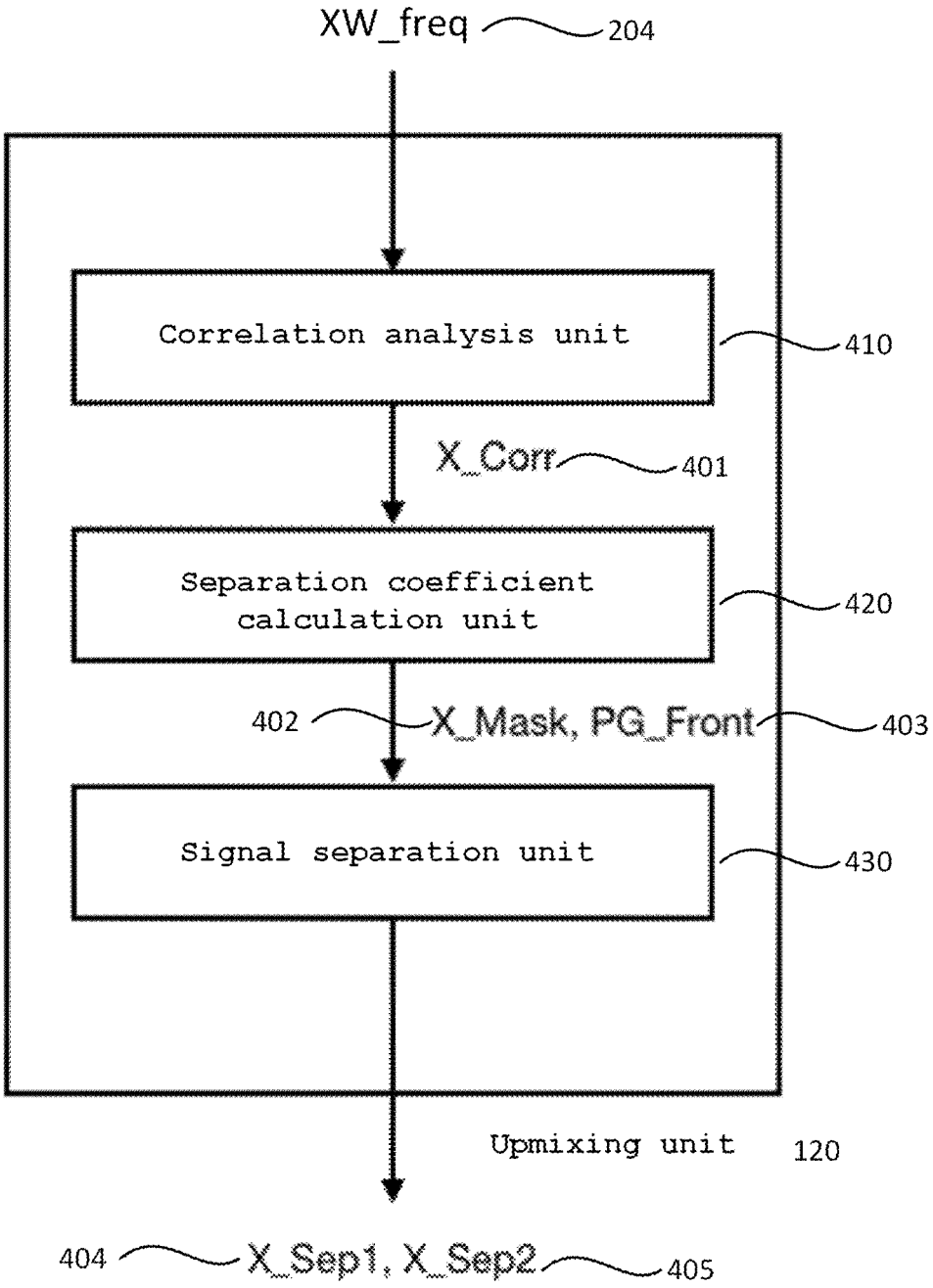
FIG. 4 illustrates an upmixing unit of an apparatus for generating an upmix binaural signal according to an embodiment of the present disclosure.

FIG. 4 illustrates an upmixing unit of an apparatus for generating an upmix binaural signal according to an embodiment of the present disclosure.

The upmixing unit 120 may calculate band-specific or bin-specific energy of the frequency signal calculated through <Equation 3>. Specifically, as in <Equation 4>, the upmixing unit 120 may calculate X_Nrg, which is the band-specific or bin-specific energy of the frequency signal, by using the product of the left/right signals of the frequency signal calculated through <Equation 3>.

$$X_Nrg[I][L][L][k]=XW_freq[I][L][k]*conj(XW_freq[I][L][k])$$

$$X_Nrg[I][L][R][k]=XW_freq[I][L][k]*conj(XW_freq[I][R][k])$$

$$X_Nrg[I][R][R][k]=XW_freq[I][R][k]*conj(XW_freq[I][R][k]) \quad \text{[Equation 4]}$$

Here, conj(x) may be a function that outputs a complex conjugate of x.

X_Nrg calculated using <Equation 4> is a parameter for the l-th frame itself. Accordingly, the upmixing unit 120 may calculate X_SNrg, which is a weighted time average value for calculating coherence in a time domain. Specifically, the upmixing unit 120 may calculate X_SNrg through <Equation 5> using gamma defined as a value between 0 and 1 through a one-pole model.

$$X_SNrg[I][L][L][k]=(1-gamma)*X_SNrg[I-I][L][L][k]+gamma*X_Nrg[I][L][L][k]$$

$$X_SNrg[I][L][R][k]=(1-gamma)*X_SNrg[I-1][L][R][k]+gamma*X_Nrg[I][L][R][k]$$

$$X_SNrg[I][R][R][k]=(1-gamma)*X_SNrg[I-1][R][R][k]+gamma*X_Nrg[I][R][R][k] \quad \text{[Equation 5]}$$

A correlation analysis unit 410 may calculate X_Corr 401, which is a coherence-based normalized correlation, by using X_SNrg, as in <Equation 6>.

$$X_Corr[I][k]=(abs(X_SNrg[I][L][R][k]))/(sqrt(X_SNrg[I][L][L][k]*X_SNrg[I][R][R][k])) \quad \text{[Equation 6]}$$

abs (x) is a function that outputs the absolute value of x, and sqrt(x) is a function that outputs the square root of x.

X_Corr[l][k] denotes the correlation between frequency components of left/right signals of the k-th bin in the l-th frame signal. Here, X_Corr[l][k] has a shape that becomes closer to 1 as the number of identical components in the left/right signals increases, and that becomes closer to 0 when the left/right signals are different.

The separation coefficient calculation unit 420 may calculate a masking function (X_Mask) 402 for determining whether to pan a frequency component from the corresponding X_Corr 401 as in <Equation 7>.

$$X_Mask[l][k]=Gate\{X_Corr[l][k]\} \quad \text{[Equation 7]}$$

The Gate{ } function of <Equation 7> is a mapping function capable of making a decision.

Figure 5:
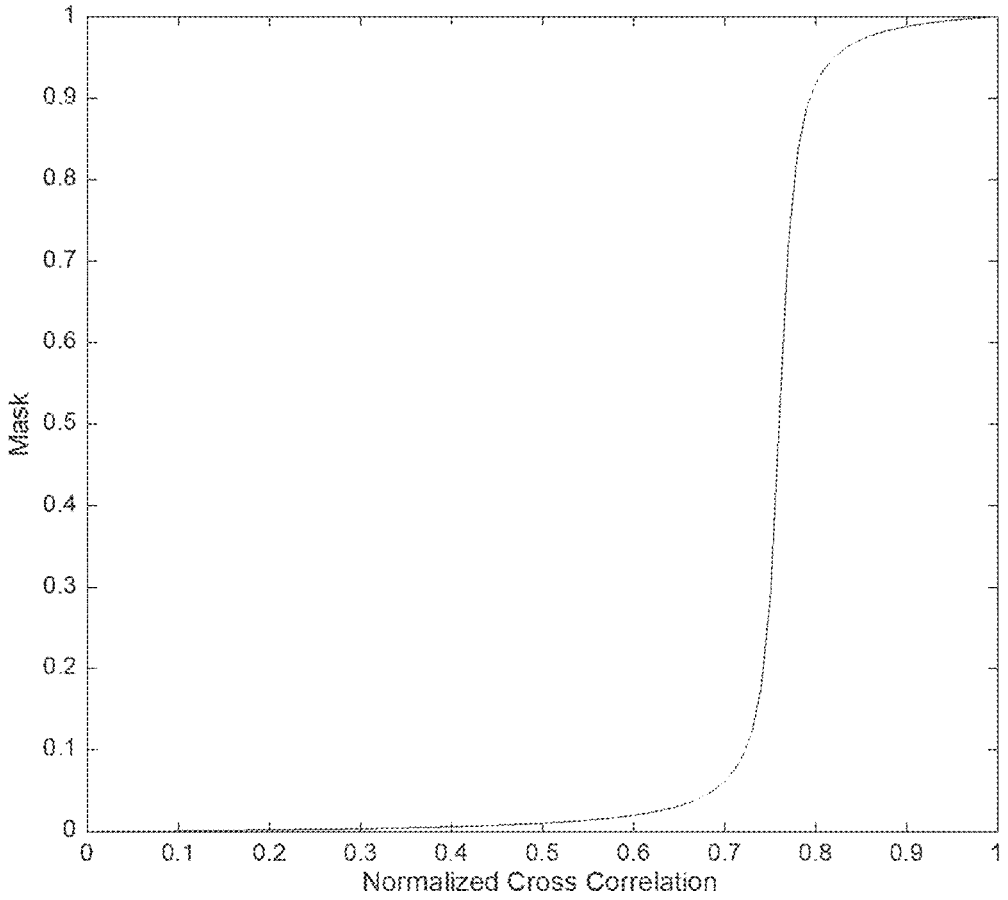
FIG. 5 is a graph showing a soft decision function according to an embodiment of the present disclosure.

FIG. 5 is a graph showing a soft decision function according to an embodiment of the present disclosure. Specifically, FIG. 5 illustrates an example of a soft decision function that uses "0.75" as a threshold.

In the case of a system in which a frame size is fixed, there is a high probability that the normalized cross correlation of a relatively low-frequency component has a higher value than the normalized cross correlation of a high-frequency component. Therefore, a gate function may be defined as a function for frequency index k. As a result, X_Mask[l][k] distinguishes directionality or an ambient level of the left and right stereo signals of the k-th frequency component in the l-th frame.

The separation coefficient calculation unit 420 may render a signal, the directionality of which is determined by X_Mask 402 based on coherence, as a frontal signal, and a signal, which is determined by the ambient level, as a signal corresponding to a lateral side. Here, in a case where the separation coefficient calculation unit 420 renders all signals corresponding to the directionality as frontal signals, the sound image of the left- and right-panned signals may be narrow. For example, a signal having a left- and right-panning degree of 0.9:0.1 and biased to the left side may also be rendered as a frontal signal rather than a side signal. Therefore, when the left/right components of the signal determined by the directionality are biased to one side, some components need to be rendered as side signals. Accordingly, the separation coefficient calculation unit 420 may extract PG_Front 403 as in <Equation 8> or <Equation 9> so as to allocate a ratio of the frontal signal rendering component ratio to the directional component to be 0.1:0.1, and to allocate a ratio of the rear signal rendering component to the direction component to be 0.8:0.

$$PG_Front[l][L][k]=\min(1,X_Nrg[l][R][R][k]/X_Nrg[l][L][L][k])$$

$$PG_Front[l][R][k]=\min(1,X_Nrg[l][L][L][k]/X_Nrg[l][R][R][k]) \quad \text{[Equation 8]}$$

$$PG_Front[l][L][k]=\mathrm{sqrt}(\min(1,X_Nrg[l][R][R][k]/X_Nrg[l][L][L][k]))$$

$$PG_Front[l][R][k]=\mathrm{sqrt}(\min(1,X_Nrg[l][L][L][k]/X_Nrg[l][R][R][k])) \quad \text{[Equation 9]}$$

When X_Mask 402 and PG_Front 403 are determined, the signal separation unit 430 may separate XW_freq 204, which is an input signal, into X_Sep1 404, which is a frontal stereo signal, and X_Sep2 405, which is a side stereo signal. Here, the signal separation unit 430 may use <Equation 10> in order to separate XW_freq 204 into X_Sep1 404, which is a frontal stereo signal, and the X_Sep2 405, which is a side stereo signal.

$$X_Sep1[l][L][k]=XW_freq[l][L][k]*X_Mask[l][k]*PG_Front[l][L][k]$$

$$X_Sep1[l][R][k]=XW_freq[l][R][k]*X_Mask[l][k]*PG_Front[l][R][k]$$

$$X_Sep2[l][L][k]=XW_freq[l][L][k]-X_Sep1[l][L][k]$$

$$X_Sep2[l][R][k]=XW_freq[l][R][k]-X_Sep1[l][R][k] \quad \text{[Equation 10]}$$

In other words, the X_Sep1 404 and the X_sep2 405 may be separated based on correlation analysis and a left/right energy ratio of the frequency signal XX freq 204. Here, the sum of the separated signals X_Sep1 404 and X_Sep2 405 may be the same as the input signal XX freq 204. The sum of a left-channel signal of X_Sep1 404 and a left-channel signal of X_Sep2 405 may be the same as a left-channel signal of the frequency signals XW_freq 204. In addition, the sum of a right-channel signal of X_Sep1 404 and a right-channel signal of X_Sep2 405 may be the same as a right-channel signal of the frequency signals XX freq 204. The energy of the left-channel signal of X_Sep1 404 may be the same as energy of the right-channel signal of X_Sep1 404.

Figure 6:
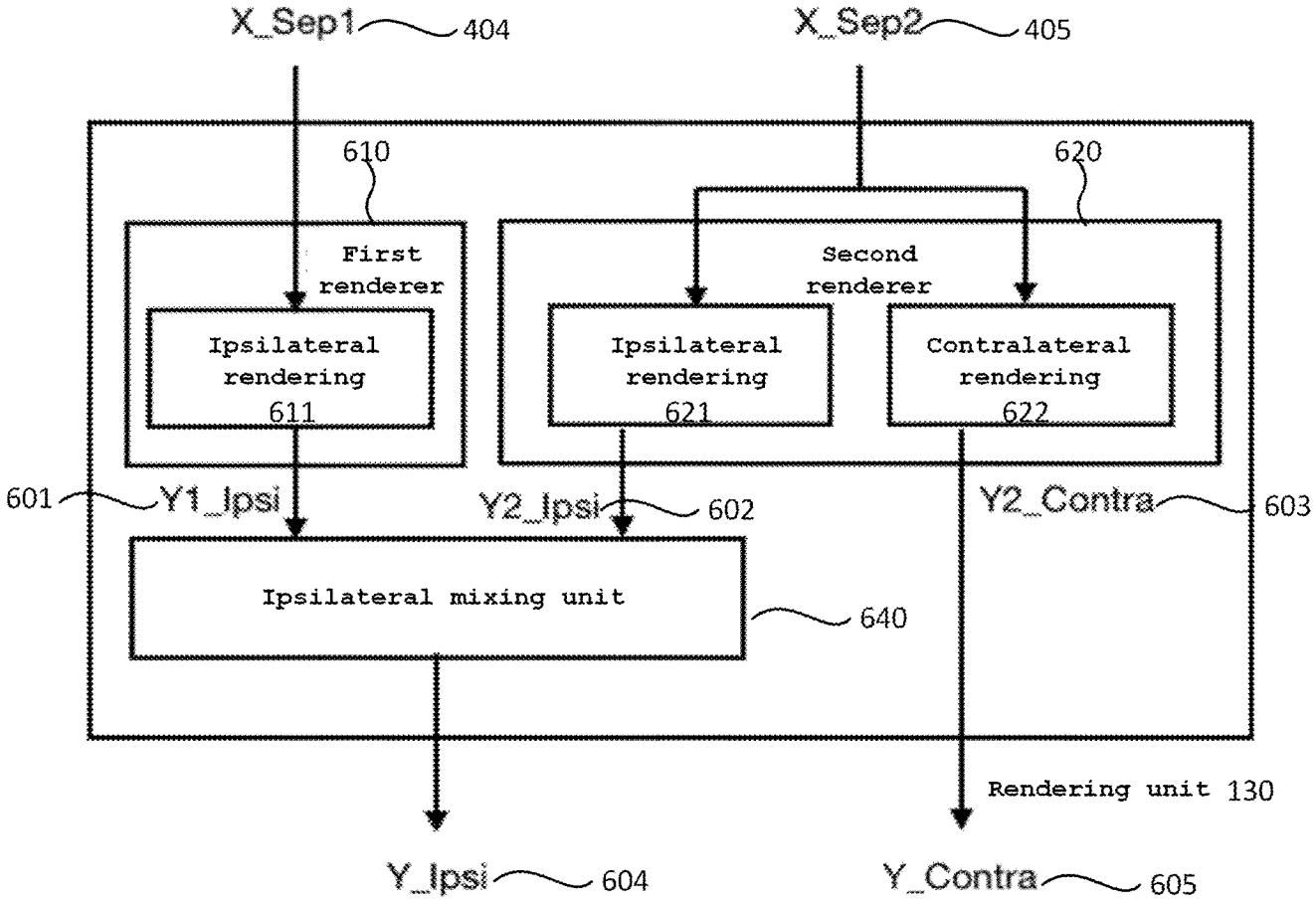
FIG. 6 illustrates a rendering unit of an apparatus for generating an upmix binaural signal according to an embodiment of the present disclosure.

FIG. 6 illustrates a rendering unit of an apparatus for generating an upmix binaural signal according to an embodiment of the present disclosure.

Referring to FIG. 6, the rendering unit 130 may receive the separated frontal stereo signal X_Sep1 404 and side stereo signal X_Sep2 405, and may output the binaural rendered ipsilateral signal Y_Ipsi 604 and contralateral signal Y_Contra 605.

X_Sep1 404, which is a frontal stereo signal, includes similar components in the left/right signals thereof. Therefore, in the case of filtering a general HRIR, the same component may be mixed both in the ipsilateral component and in the contralateral component. Therefore, comb filtering due to ITD may occur. Accordingly, a first renderer 610 may perform ipsilateral rendering 611 for the frontal stereo signal. In other words, the first renderer 610 uses a method of generating a frontal image by reflecting only the ipsilateral spectral characteristic provided by the HRIR, and may not generate a component corresponding to the contralateral spectral characteristic. The first renderer 610 may generate the frontal ipsilateral signal Y1_Ipsi 601 according to <Equation 11>. H1_Ipsi in <Equation 11> refers to a filter that reflects only the ipsilateral spectral characteristics provided by the HRIR, that is, an ipsilateral filter generated based on the HRIR at the frontal channel location. Meanwhile, comb filtering by the ITD may be used to change sound color or localize the sound image in front. Therefore, H1_Ipsi may be obtained by reflecting both the ipsilateral component and the contralateral component of HRIR. Here, the contralateral component of HRIR may be obtained by reflecting ITD, and H1_Ipsi may include comb filtering characteristics due to the ITD.

$$Y1_Ipsi[l][L][k]=X_Sep1[l][L][k]*H1_Ipsi[l][L][k]$$

$$Y1_Ipsi[l][R][k]=X_Sep1[l][R][k]*H1_Ipsi[l][R][k] \quad \text{[Equation 11]}$$

Since X_Sep2 405, which is a side stereo signal, does not contain similar components in the left/right signals thereof, even if general HRIR filtering is performed, a phenomenon in which the same component is mixed both in the ipsilateral component and in the contralateral component does not occur. Therefore, sound quality deterioration due to comb filtering according to ITD does not occur. Accordingly, a second renderer 620 may perform ipsilateral rendering 621 and contralateral rendering 622 for the side stereo signal. In other words, the second renderer 620 may generate the side ipsilateral signal Y2_Ipsi 602 and the side contralateral signal Y2_Contra 603 according to <Equation 12> by performing ipsilateral filtering and contralateral filtering having HRIR characteristics, respectively. In <Equation 12>, H2_Ipsi denotes an ipsilateral filter generated based on the HRIR at the side channel location, and H2_Contra denotes a contralateral filter generated based on the HRIR at the side channel location.

The frontal ipsilateral signal Y1_Ipsi 601, the side ipsilateral signal Y2_Ipsi 602, and the side contralateral signal Y2_Contra 603 may each include left/right signals. Here, H1_Ipsi may also be a left/right filter thereof, an H1_Ipsi left filter may be applied to the left signal of the frontal ipsilateral signal Y1_Ipsi 602, and an H1_Ipsi right filter may be applied to the right signal of the frontal ipsilateral signal Y1_Ipsi 602. The side ipsilateral signals Y2_Ipsi 602 and H2_Ipsi, and the side contralateral signals Y2_Contra 603 and H2_Contra may be subject to the same application.

$$Y2_Ipsi[l][L][k]=X_Sep2[l][L][k]*H2_Ipsi[l][L][k]$$

$$Y2_Ipsi[l][R][k]=X_Sep2[l][R][k]*H2_Ipsi[l][R][k]$$

$$Y2_Contra[l][L][k]=X_Sep2[l][L][k]*H2_Contra[l][L][k]$$

$$Y2_Contra[l][R][k]=X_Sep2[l][R][k]*H2_Contra[l][R][k] \quad \text{[Equation 12]}$$

The ipsilateral mixing unit 640 may mix the Y1_Ipsi 601 and the Y2_Ipsi 602 to generate the final binaural ipsilateral signal Y_Ipsi 604. The ipsilateral mixing unit 640 may generate the final binaural ipsilateral signal (Y_Ipsi) 604 for each of the left and right channels by mixing the Y1_Ipsi 601 and the Y2_Ipsi 602 according to each of left and right channels, respectively. Here, frequency-specific phases of X_Sep1 404 and X_Sep2 405, shown in FIG. 4, have the same shape. Accordingly, when there is a phase difference between H1_Ipsi and H2_Ipsi, artifacts such as comb filtering may occur. However, according to an embodiment of the present disclosure, both H1_Ipsi and H2_Ipsi are defined as real numbers, and thus the problem such as comb filtering can be solved.

In addition, in an overlap-and-add structure of "analysis windowing->time/frequency transform->processing->frequency/time transform->synthesis windowing", which is an example of an overall system flow for generating a binaural signal according to the present disclosure, if complex filtering is performed in a processing domain, the assumption of perfect reconstruction may be broken by aliasing due to a phase change. Accordingly, all of H1_Ipsi, H2_Ipsi, and H2_Contra used in the rendering unit 130 of the present disclosure may be configured by real numbers. Therefore, a signal before rendering has the same phase as a signal after rendering. Specifically, the phase of a left channel of the signal before rendering and the phase of a left channel of the signal after rendering may be the same. Likewise, the phase of a right channel of the signal before rendering and the phase of a right channel of the signal after rendering may be the same. The rendering unit 130 may calculate and/or generate the Y_Ipsi 604 and Y_Contra 605 as signals in the frequency domain by using <Equation 13>. Y_Ipsi 604 and Y_Contra 605 may be generated through mixing in each of the left and right channels. The final binaural contralateral signal Y_Contra 605 may have the same value as the side contralateral signal Y2_Contra 603.

$$Y_Ipsi[l][L][k]=Y1_Ipsi[l][L][k]+Y2_Ipsi[l][L][k]$$

$$Y_Ipsi[l][R][k]=Y1_Ipsi[l][R][k]+Y2_Ipsi[l][R][k]$$

$$Y_Contra[l][L][k]=Y2_Contra[l][L][k]$$

$$Y_Contra[l][R][k]=Y2_Contra[l][R][k] \quad \text{[Equation 13]}$$

Figure 7:
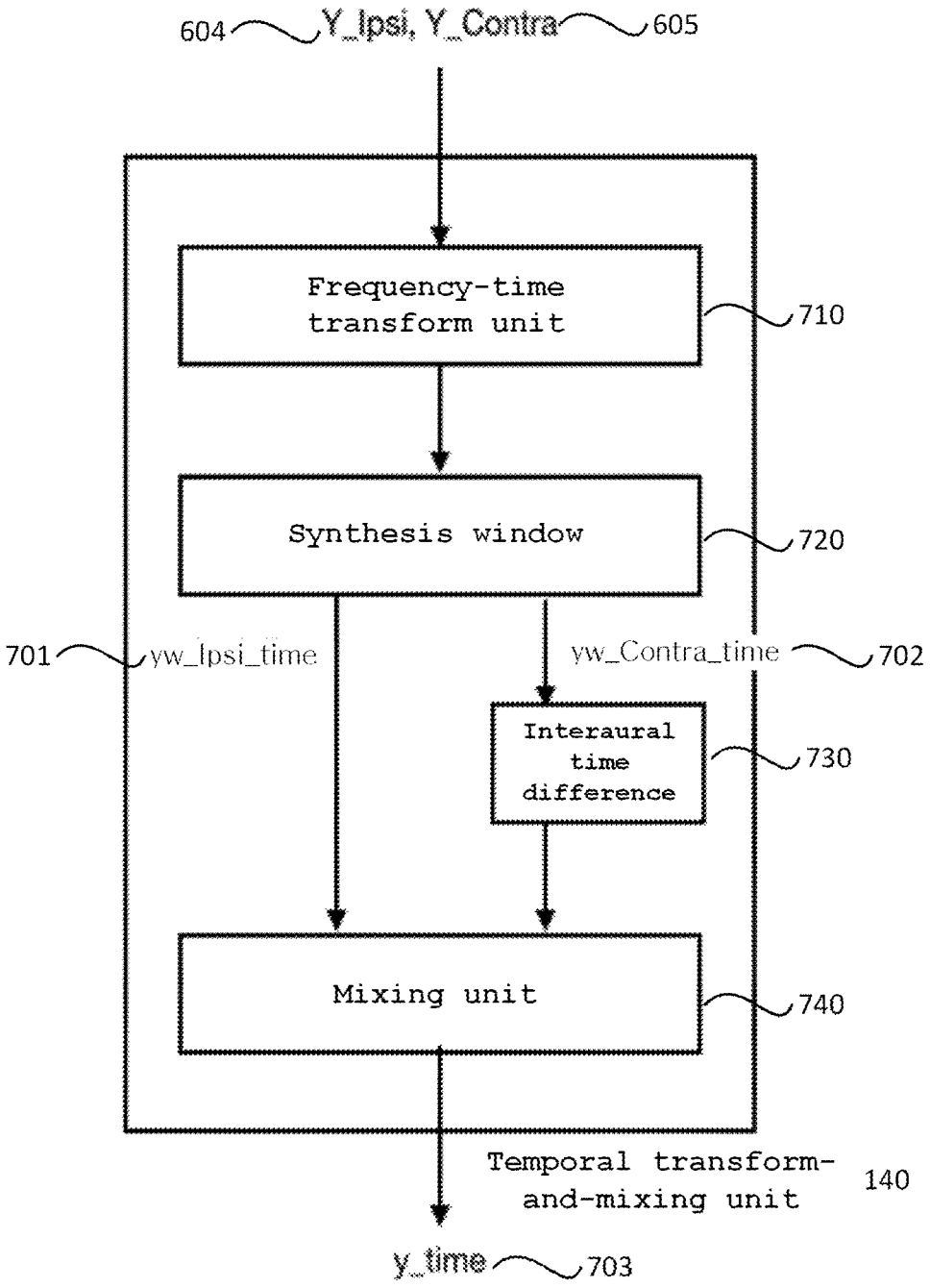
FIG. 7 illustrates a temporal transform-and-mixing unit of an apparatus for generating an upmix binaural signal according to an embodiment of the present disclosure.

FIG. 7 illustrates a temporal transform-and-mixing unit of an apparatus for generating an upmix binaural signal according to an embodiment of the present disclosure.

Referring to FIG. 7, Y_Ipsi 604 and Y_Contra 605, calculated and/or generated by the rendering unit 130 of FIG. 6, are transformed into signals in a time domain through the temporal transform-and-mixing unit 140. In addition, the temporal transform-and-mixing unit 140 may generate y_time 703, which is a final upmixed binaural signal.

The frequency-time transform unit 710 may transform Y_Ipsi 604 and Y_Contra 605, which are signals in a frequency domain, into signals in a time domain through an inverse discrete Fourier transform (IDFT) or a synthesis filterbank. The frequency-time transform unit 710 may generate yw_Ipsi_time 701 and yw_Contra_time 702 according to <Equation 14> by applying a synthesis window 720 to the signals.

$$yw_Ipsi_time[l][L][1:NF]=IDFT\{Y_Ipsi[l][L][1:NF]\}*wind[1:NF]$$

$$yw_Ipsi_time[l][R][1:NF]=IDFT\{Y_Ipsi[l][R][1:NF]\}*wind[1:NF]$$

$$yw_Contra_time[l][L][1:NF]=IDFT\{Y1_Contra[l][L][1:NF]\}*wind[1:NF]$$

$$yw_Contra_time[l][R][1:NF]=IDFT\{Y1_Contra[l][R][1:NF]\}*wind[1:NF] \quad \text{[Equation 14]}$$

A final binaural rendering signal y_time 703 may be generated by using yw_Ipsi_time 701 and yw_Contra_time 702, as in <Equation 15>. Referring to <Equation 15>, the temporal transform-and-mixing unit 140 may assign, to the signal yw_Contra_time 702, an interaural time difference (ITD), which is a delay for side binaural rendering, that is, may assign as many ITDs as delay D (indicated by reference numeral 730). For example, the ITD may have a value of 1 millisecond (ms) or less. In addition, the mixing unit 740 of the temporal transform-and-mixing unit 140 may generate a final binaural signal y_time 703 through an overlap-and-add method. The final binaural signal y_time 703 may be generated for each of left and right channels.

$$\begin{aligned} y_time[L][(I-1)*NH+1:(I+1)*NH] &= \\ y_time[L][(I-1)*NH+1:(I+1)*NH] &+ \\ yw_Ipsi_time[I][L][1:NF] &+ \\ [yw_Contra_time[I-1][R](NF-D+1):NF] & \\ yw_Contra_time[I][R][1:(NF-D)]] & \\ y_time[R][(I-1)*NH+1:(I+1)*NH] &= \\ y_time[R][(I-1)*NH+1:(I+1)*NH] & \end{aligned} \quad \text{[Equation 15]}$$

Spatial Sound Improvement Algorithm Using Upmix Binaural Signal Generation

Figure 8:
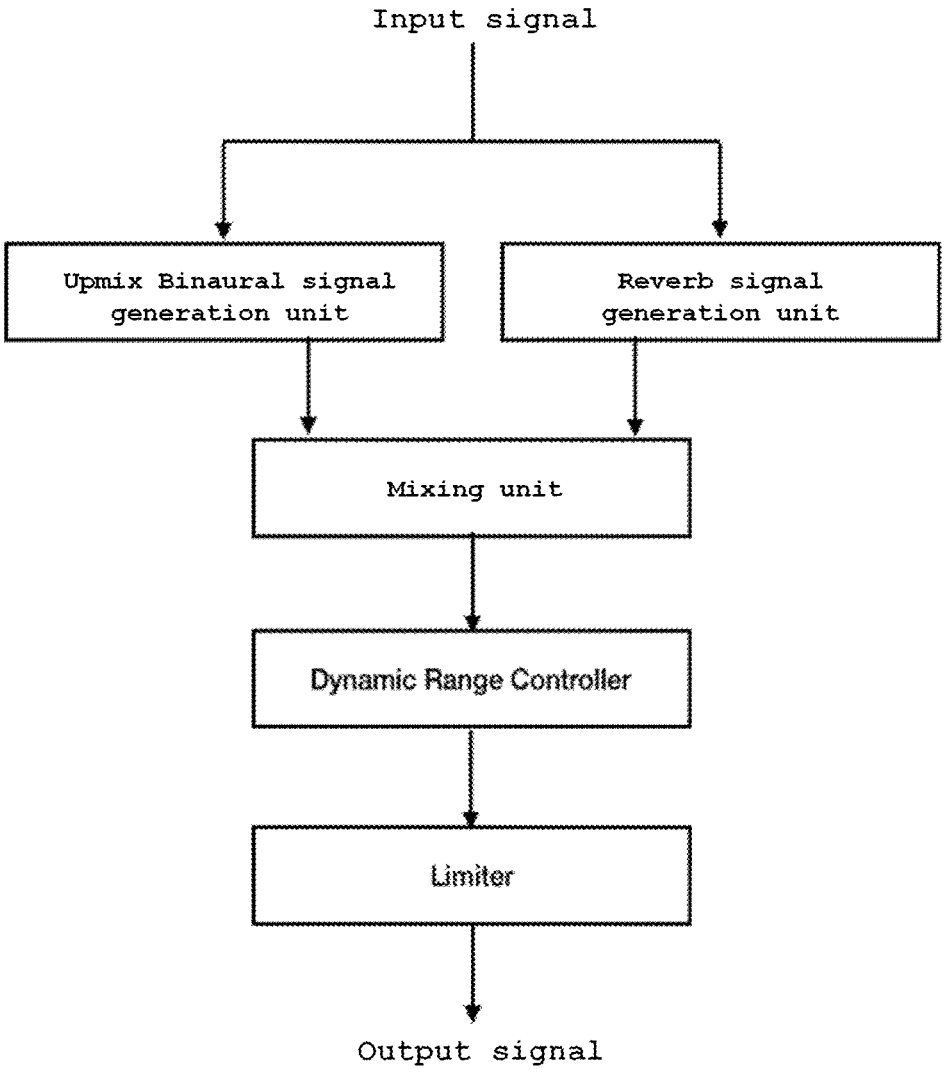
FIG. 8 illustrates an algorithm for improving spatial sound using an upmix binaural signal generation algorithm according to an embodiment of the present disclosure.

FIG. 8 illustrates an algorithm for improving spatial sound using an upmix binaural signal generation algorithm according to an embodiment of the present disclosure.

An upmix binaural signal generation unit shown in FIG. 8 may synthesize a binaural signal with respect to a direct sound through binaural filtering after upmixing. A reverb signal generation unit (reverberator) may generate a reverberation component. The mixing unit may mix a direct sound and a reverberation component. A dynamic range controller may selectively amplify a small sound of a signal obtained by mixing the direct sound and the reverberation component. A limiter may synthesize the amplified signal with a stabilized signal and output the same so as not to allow clipping in the amplified signal. The conventional algorithm may be used to generate a reverberation component in the reverb signal generation unit. For example, there may be a reverberator in which a plurality of delay gains and all-pass are combined using the conventional algorithm.

Figure 9:
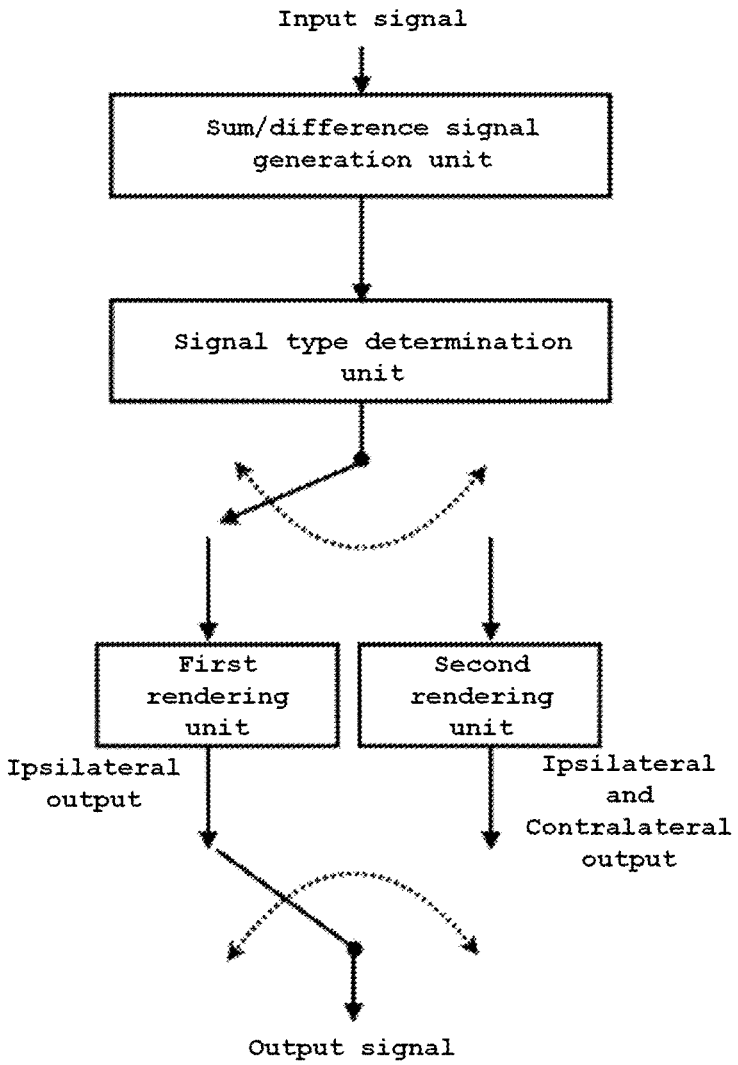
FIG. 9 illustrates a simplified upmix binaural signal generation algorithm for a server-client structure according to an embodiment of the present disclosure.

Simplified Upmix Binaural Signal Generation Algorithm for Server-Client Structure FIG. 9 illustrates a simplified upmix binaural signal generation algorithm for a server-client structure according to an embodiment of the present disclosure.

FIG. 9 illustrates a simplified system configuration in which rendering is performed by making a binary decision based on one of an effect of a first rendering unit or an effect of a second rendering unit according to an input signal. A first rendering method, which is performed by the first rendering unit, may be used in a case where the input signal includes a large number of left/right mixed signals and thus frontal rendering thereof is performed. A second rendering method, which is performed by the second rendering unit, may be used in a case where the input signal includes few left/right mixed signals and thus side rendering thereof is performed. A signal type determination unit may determine the method to be used among the first rendering method and the second rendering method. Here, the determination can be made through correlation analysis for the entire input signal without frequency transform thereof. The correlation analysis may be performed by a correlation analysis unit (not shown).

A sum/difference signal generation unit may generate a sum signal (x_sum) and a difference signal (x_diff) for an input signal (x_time), as in <Equation 16>. The signal type determination unit may determine a rendering signal (whether to use the first rendering method TYPE_1 or the second rendering method TYPE_2) based on the sum/difference signal, as in <Equation 17>.

$$x_sum[n]=x_time[L][n]+x_time[R][n]$$

$$x_diff[n]=x_time[L][n]-x_time[R][n] \quad \text{[Equation 16]}$$

$$\text{ratioType}=\text{sqrt}(\text{abs}\{\text{SUM_(for all } n)\{x_sum[n]*x_diff[n]\}\}/\text{SUM_(for all } n)\{x_sum[n]*x_sum[n]+x_diff[n]*x_diff[n]\})$$

$$\text{rendType}=(\text{ratioType}<0.22)?(\text{TYPE_1}:\text{TYPE_2}) \quad \text{[Equation 17]}$$

If the left/right signal components of the input signal are uniformly distributed, the comb-filtering phenomenon is highly likely to occur. Accordingly, the signal type determination unit may select a first rendering method in which only an ipsilateral component is reflected without a contralateral component, as in <Equation 17>. Meanwhile, the signal type determination unit may select a second rendering method, which actively utilizes the contralateral component, when one of the left and right components of the input signal occupies a larger sound proportion than the other one. For example, referring to <Equation 17>, as the left/right signals of the input signal are similar to each other, x_diff of the numerator approaches 0, and thus ratioType approaches 0. That is, according to <Equation 17>, when ratioType is smaller than 0.22, the signal type determination unit may select TYPE_1, which denotes a first rendering method that reflects only the ipsilateral component. On the other hand, if ratioType is equal to or greater than 0.22, the signal type determination unit may select the second rendering method.

Binauralization Method for Frequency Signal Input

In a method such as post processing of an audio sound field and a codec for transmission of an audio signal, analysis and application of an audio signal in the frequency domain is performed. Therefore, a frequency-domain signal other than that of a terminal used for final reproduction may be used as an intermediate result for analysis and application of the audio signal. In addition, a frequency-domain signal may be used as an input signal for binauralization.

Figure 10:
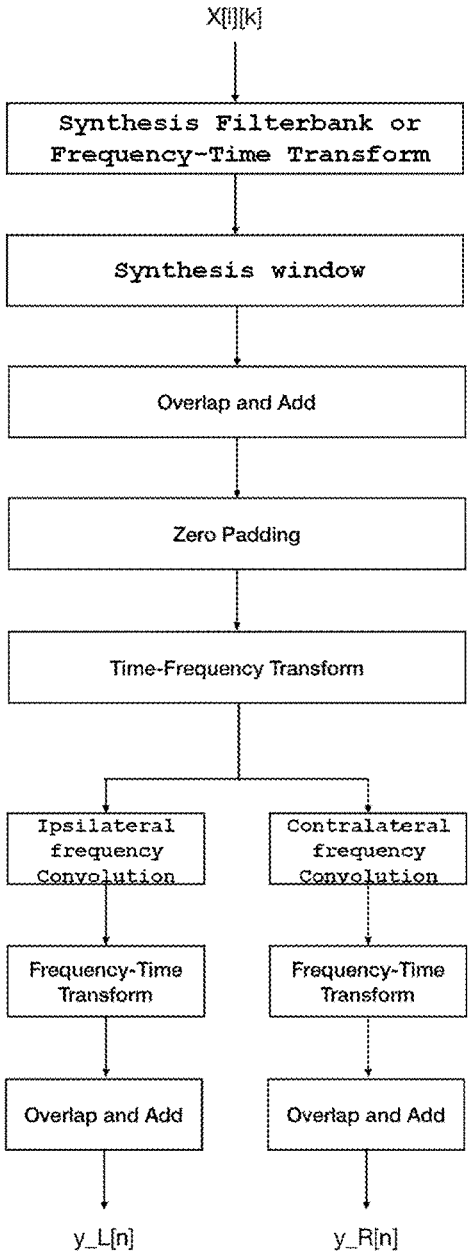
FIG. 10 illustrates a method of performing binauralization of an audio signal in a frequency domain according to an embodiment of the present disclosure.

FIG. 10 illustrates a method of performing binauralization of an audio signal in a frequency domain according to an embodiment of the present disclosure.

A frequency-domain signal may not be a signal transformed from a time-domain signal zero-padded under the assumption of circular convolution. In this case, the structure of frequency-domain signal does not allow the convolution thereof. Therefore, the frequency-domain signal is transformed into a time-domain signal. Here, the filter bank or frequency-time transform (e.g., IDFT) described above may be used. In addition, a synthesis window and processing such as overlap-and-add processing may be applied to the transformed time-domain signal. In addition, zero padding may be applied to the signal to which the synthesis window and the processing such as overlap-and-add processing is applied, and the zero-padded signal may be transformed into a frequency-domain signal through time-frequency transform (e.g., DFT). Thereafter, convolution using DFT may be applied to each of ipsilateral/contralateral components of the transformed frequency-domain signal, and frequency-time transform and overlap-and-add processing may be applied thereto. Referring to FIG. 10, in order to binauralize one input signal in a frequency domain, four number of times of transform processes are required.

Figure 11:
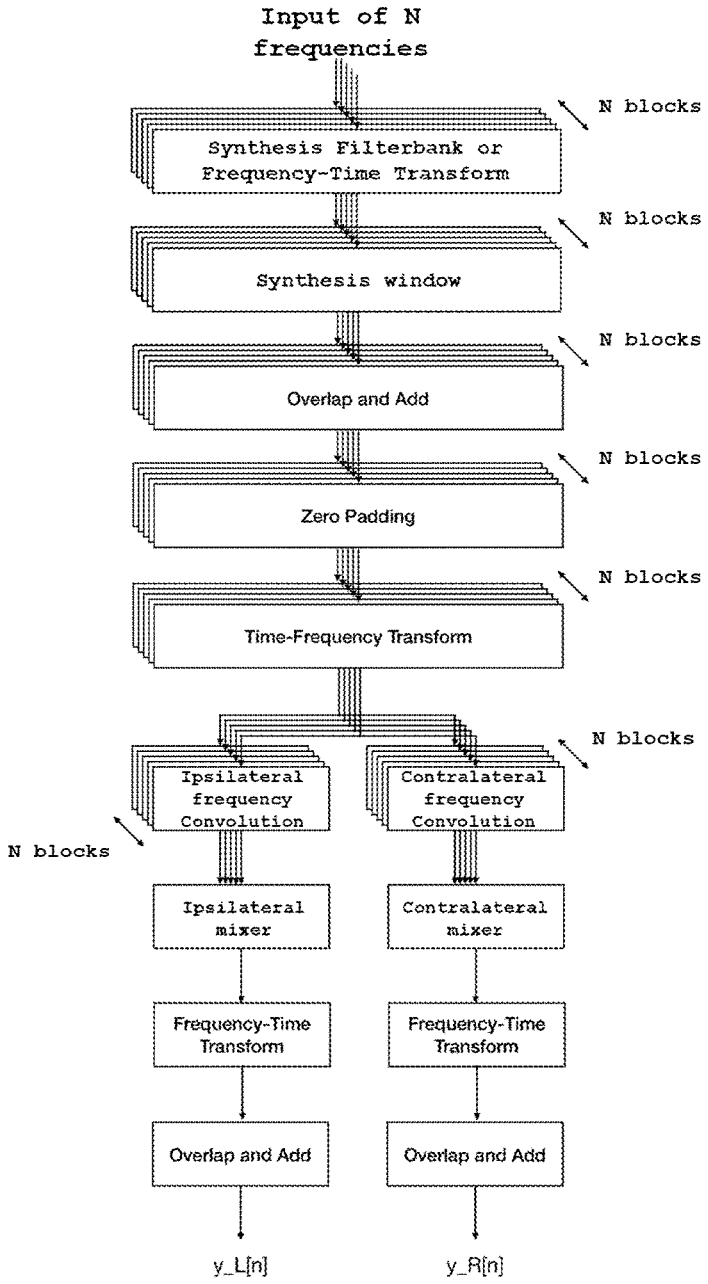
FIG. 11 illustrates a method of performing binauralization of audio input signals in a plurality of frequency domains according to an embodiment of the present disclosure.

FIG. 11 illustrates a method of performing binauralization of a plurality of audio input signals in a frequency domain according to an embodiment of the present disclosure.

FIG. 11 illustrates a method for generalized binauralization, which is extended for N input signals from the method of performing binauralization described above with reference to FIG. 10.

Referring to FIG. 11, when there are N input signals, N binauralized signals may be mixed in a frequency domain. Therefore, when the N input signals are binauralized, a frequency-time transform process can be reduced. For example, according to FIG. 11, in the case of binauralizing N input signals, N*2+2 transforms are required. Meanwhile, when the binauralization process of the input signal is performed N times according to FIG. 10, N*4 transforms are required. That is, when the method of FIG. 11 is used, the number of transforms may be reduced by (N−1)*2 compared to the case of using the method of FIG. 10.

Figure 12:
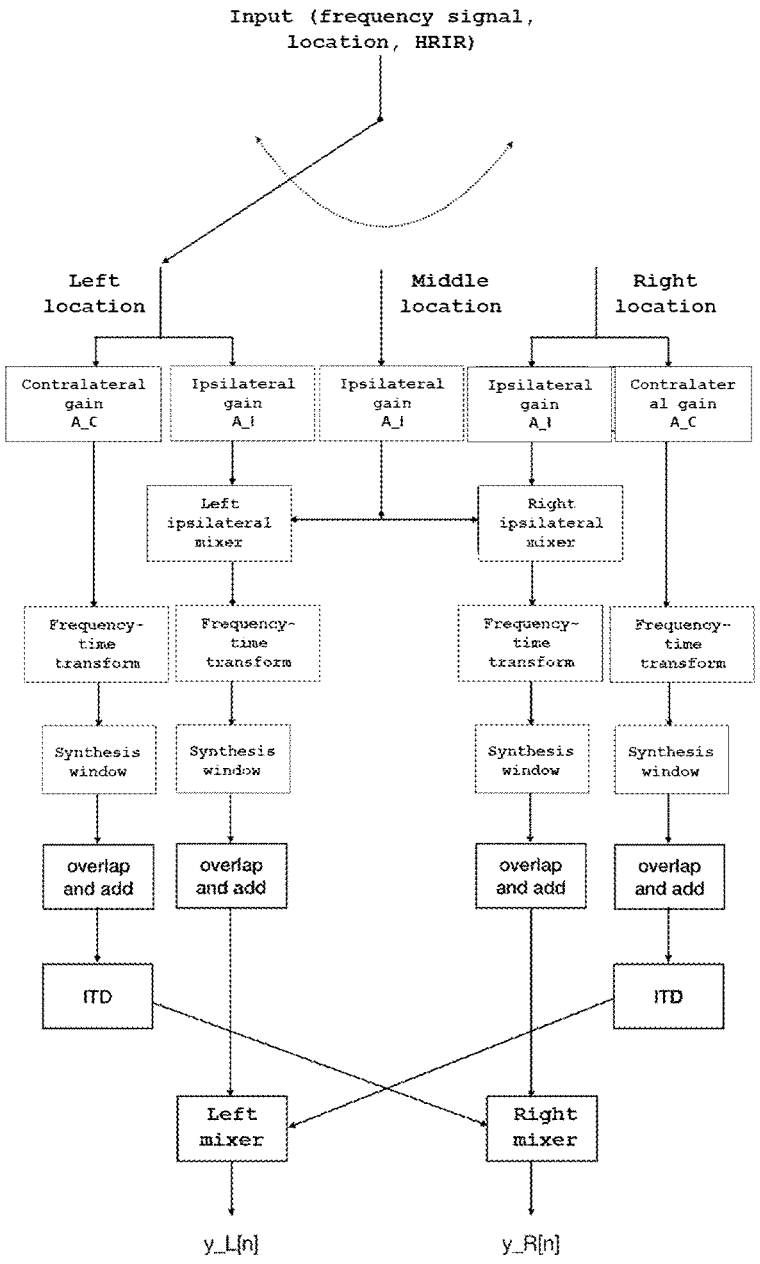
FIG. 12 illustrates a method of performing binauralization of an input signal according to an embodiment of the present disclosure.

FIG. 12 illustrates a method of performing binauralization of an input signal according to an embodiment of the present disclosure.

FIG. 12 illustrates an example of a method of binauralizing an input signal when a frequency input signal, a virtual sound source location corresponding to the frequency input signal, and a head-related impulse response (HRIR), which is a binaural transfer function, exist. Referring to FIG. 12, when the virtual sound source location exists on the left side with reference to a specific location, ipsilateral gain A_I and contralateral gain A_C may be calculated as in <Equation 18>. The ipsilateral gain A_I may be calculated as the amplitude of the left HRIR, and the contralateral gain A_C may be calculated as the amplitude of the right HRIR. In addition, the calculated A_I and A_C are multiplied by the frequency input signal X[k], and thus Y_I[k], which is an ipsilateral signal in a frequency domain, and Y_C[k], which is a contralateral signal in a frequency domain, may be calculated as in <Equation 18>.

$$A_I=|\mathrm{DFT}\{\mathrm{HRIR_Left}\}|$$

$$A_C=|\mathrm{DFT}\{\mathrm{HRIR_Right}\}|$$

$$Y_I[k]=A_I[k]\times X[k]$$

$$Y_C[k]=A_C[k]\times X[k] \quad \text{[Equation 18]}$$

$$y_I=\mathrm{IDFT}\{Y_I\}$$

$$y_c=\mathrm{IDFT}\{Y_C\} \quad \text{[Equation 19]}$$

Y_I[k] and Y_C[k], which are frequency-domain signals calculated in <Equation 18>, are transformed into signals in a time domain as in <Equation 19> through frequency-time transform. In addition, a synthesis window and an overlap-and-add process may be applied to the transformed time-domain signal as needed. Here, the ipsilateral signal and the contralateral signal may be generated as signals in which ITD is not reflected. Accordingly, as shown in FIG. 12, ITD may be forcibly reflected in the contralateral signal.

$$A_I=|\mathrm{DFT}\{\mathrm{HRIR_Right}\}|$$

$$A_C=|\mathrm{DFT}\{\mathrm{HRIR_Left}\}|$$

$$Y_I[k]=A_I[k]\times X[k]$$

$$Y_C[k]=A_C[k]\times X[k] \quad \text{[Equation 20]}$$

When the virtual sound source exists on the right side with reference to a specific location, <Equation 20> may be used to calculate the ipsilateral gain and contralateral gain, rather than <Equation 18>. In other words, there is a change only in mapping of the left and right outputs of the ipsilateral side and the contralateral side. When the virtual sound source exists in the center with reference to a specific location, both methods that have been used when the virtual sound source exists on the left side or the right side described above can be applied. If the virtual sound source exists in the center with reference to a specific location, ITD may be 0. Referring to FIG. 12, when the virtual sound source is in the center, that is, when HRIR_Left and HRIR_Right are the same, the frequency-time transform process may be reduced once more compared to the case where the virtual sound source exists on the left/right sides.

Hereinafter, in the present specification, a method of calculating a specific value of ITD will be described. The method of calculating the specific value of the ITD includes a method of analyzing an interaural phase difference of HRIR, a method of utilizing location information of a virtual sound source, and the like. Specifically, a method of calculating and assigning an ITD value by using location information of a virtual sound source according to an embodiment of the present disclosure will be described.

Figure 13:
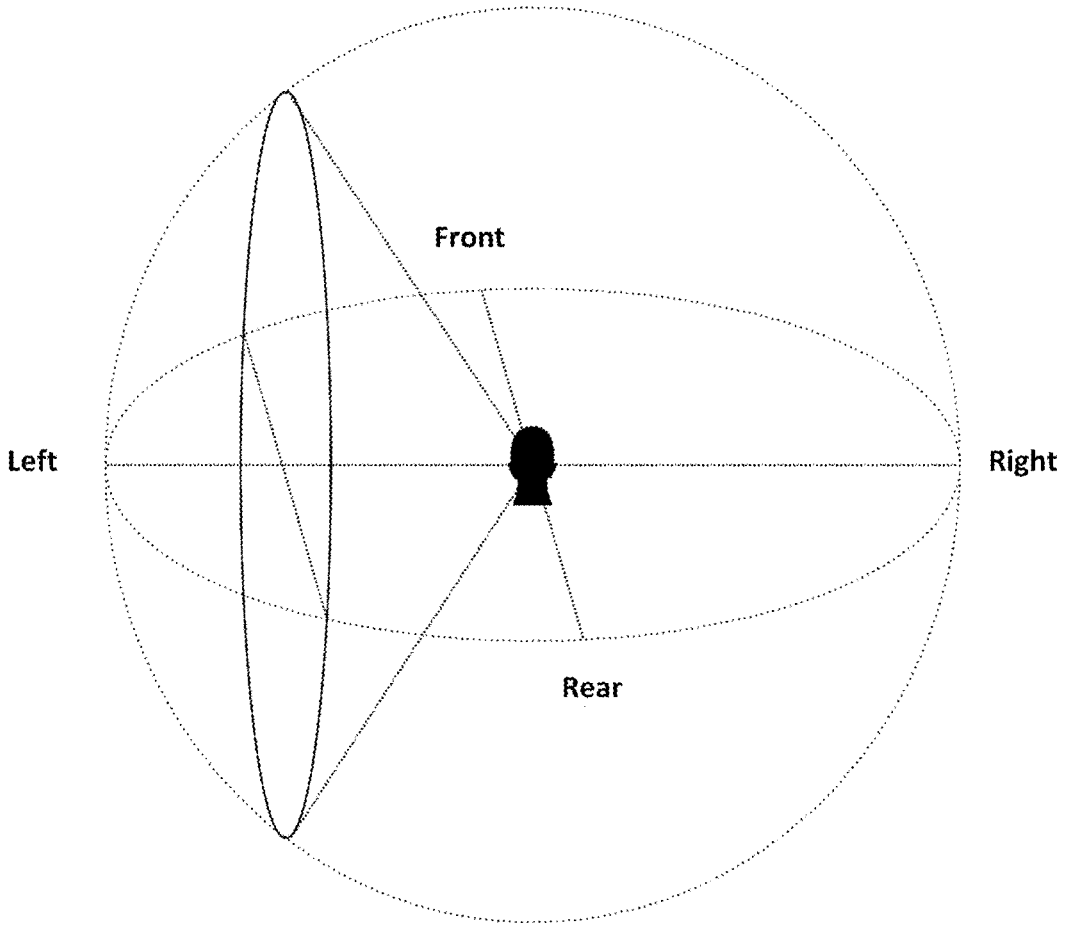
FIG. 13 illustrates a cone of confusion according to an embodiment of the present disclosure.

FIG. 13 illustrates a cone of confusion (CoC) according to an embodiment of the present disclosure.

The cone of confusion (CoC) may be defined as a circumference with the same interaural time difference. The CoC is a part indicated by the solid line in FIG. 13, and when the sound source existing in the CoC is binaurally rendered, the same ITD may be applied.

An interaural level difference, which is a binaural cue, may be implemented through a process of multiplying the ipsilateral gain and the contralateral gain in a frequency domain. ITD can be assigned in a time domain while delaying the buffer. In the embodiment of FIG. 10, four transforms are required to generate a binaural signal, but in the embodiment of FIG. 12, only one or two transforms are required, thereby reducing the amount of computation.

Figure 14:
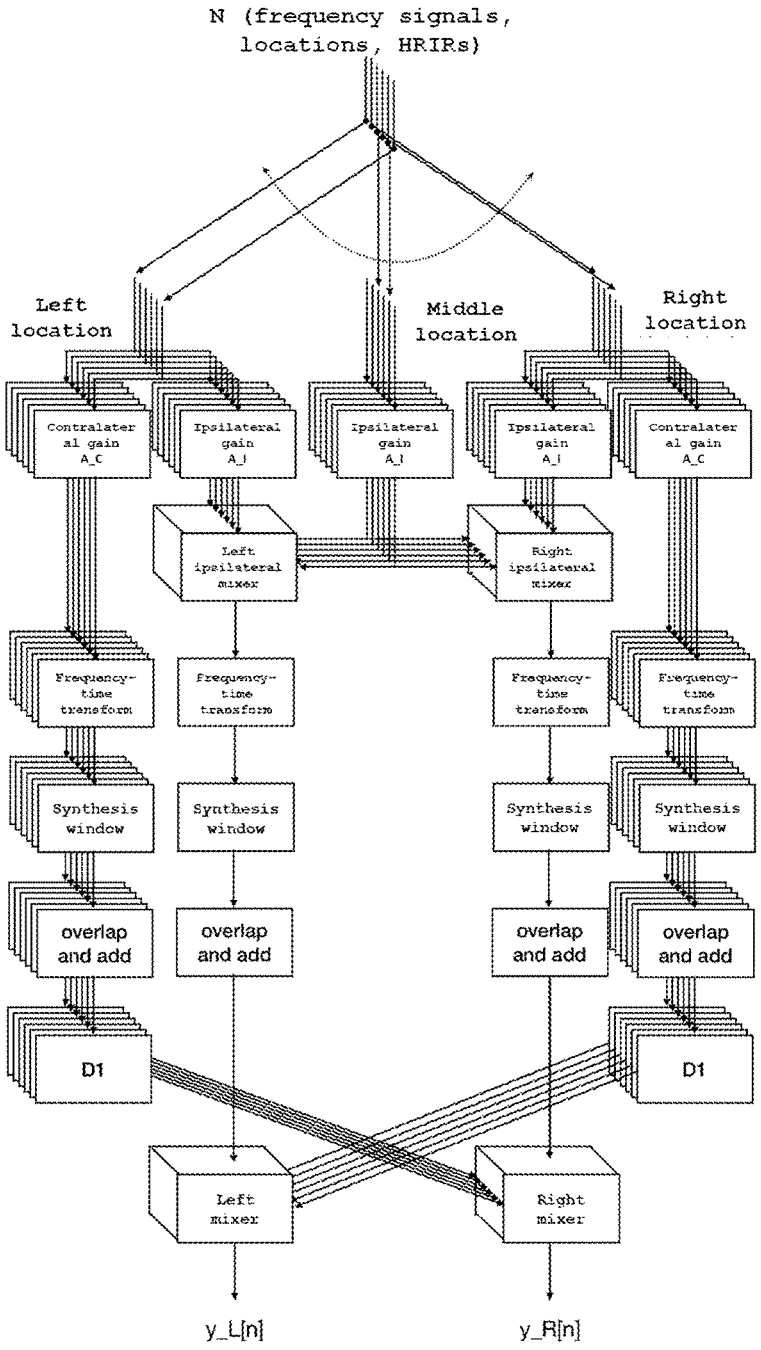
FIG. 14 illustrates a binauralization method for a plurality of input signals according to an embodiment of the present disclosure.

FIG. 14 illustrates a method for binauralizing a plurality of input signals according to an embodiment of the present disclosure.

FIG. 14 illustrates a method for generalized binauralization, which is extended for N input signals from the method of performing binauralization described above with reference to FIG. 12. That is, FIG. 14 illustrates the case in which a plurality of sound sources exist. Referring to FIG. 14, when there are N frequency input signals, a virtual sound source location corresponding to the frequency input signal, and a head-related impulse response (HRIR), which is a binaural transfer function, illustrated is a structure in which ipsilateral signals without time delay are mixed in a frequency domain by using the left ipsilateral mixer and the right ipsilateral mixer and are then processed. In the case of FIG. 11, N*2+2 transforms are required, but according to FIG. 14, the maximum number of transforms required for N inputs is N+2, thereby reducing the number transforms by about half.

Figure 15:
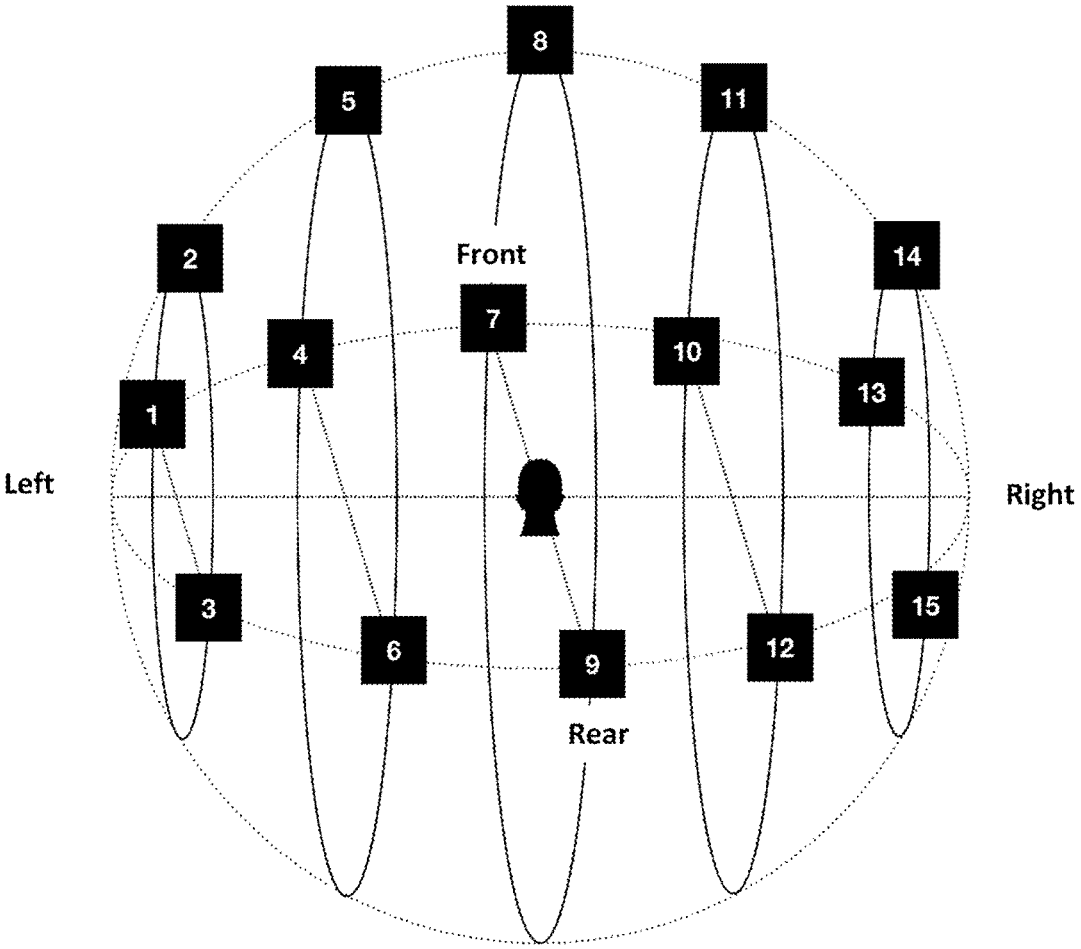
FIG. 15 illustrates a case where a virtual input signal is located in a cone of confusion according to an embodiment of the present disclosure.

FIG. 15 illustrates a case in which a virtual input signal is located in a cone of confusion (CoC) according to an embodiment of the present disclosure.

Specifically, FIG. 15 illustrates a method of binauralizing a virtual sound source when the virtual sound source is located in the CoC. As shown in FIG. 15, when the virtual sound source is located in the CoC, contralateral signals may be frequency-time-transformed after being combined together. For example, as shown in FIG. 15, when three speakers are placed in one CoC to binauralize a total of 15 virtual input signals, an apparatus for generating binaural signals may binauralize the virtual input signals by performing frequency transform only six. Therefore, in the case of FIG. 11 described above, when there are 15 speakers (virtual sound sources), 32 transforms (N*2+1=15*2+2) are required. However, in the case of FIG. 15, a binaural signal can be generated by six transforms according to FIG. 16, and thus the number of transforms can be reduced by about 80%.

Figure 16:
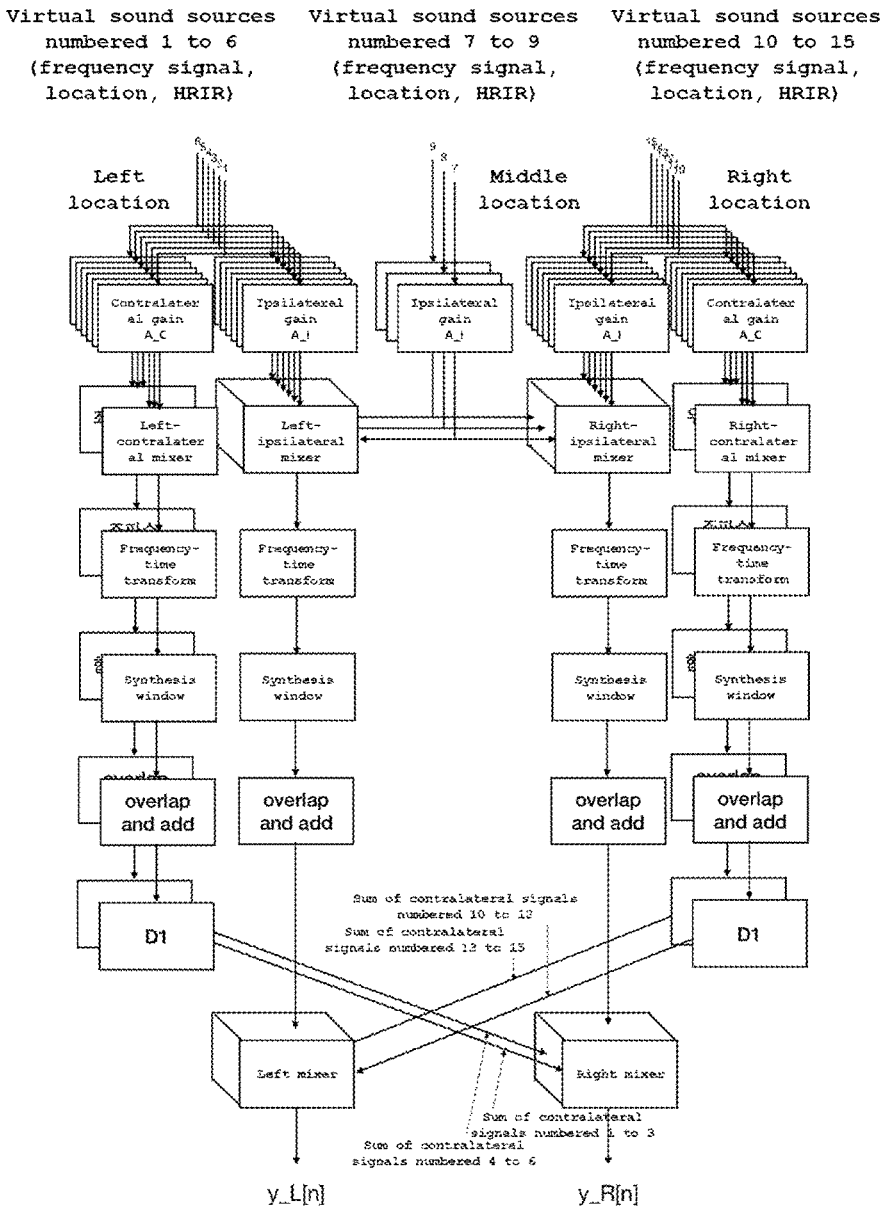
FIG. 16 illustrates a method of binauralizing a virtual input signal according to an embodiment of the present disclosure.

FIG. 16 illustrates a method of binauralizing a virtual input signal according to an embodiment of the present disclosure.

Referring to FIG. 16, transform of the contralateral signals of virtual sound sources of speakers existing at locations numbered 1 to 3 of FIG. 15 may be performed only once, not three times. The same is applied to virtual sound sources of speakers existing at locations numbered 4 to 6, virtual sound sources of speakers existing at locations numbered 10 to 12, and virtual sound sources of speakers existing at locations numbered 13 to 15.

According to an embodiment of the present disclosure, when an apparatus for generating a binaural signal performs binauralization of a virtual sound source, all ipsilateral components may be mixed in an in-phase form. In general, due to a time difference of HRIR used for binauralization, a tone change due to frequency interference may occur, resulting in deterioration of sound quality. However, the ipsilateral gain A_I applied in an embodiment of the present disclosure deals only with the frequency amplitude of the ipsilateral HRIR. Therefore, the original phase of the signal to which the ipsilateral gain A_I is applied may be maintained. Therefore, unlike general HRIR, which is characterized in that the arrival time of an ipsilateral component differs depending on the direction of sound, the embodiment can remove differences in arrival time of an ipsilateral component for each direction to make the arrival time of the ipsilateral component uniform. That is, when one signal is distributed to a plurality of channels, the embodiment can remove coloration according to the arrival time, which occurs when a general HRIR is used.

Figure 17:
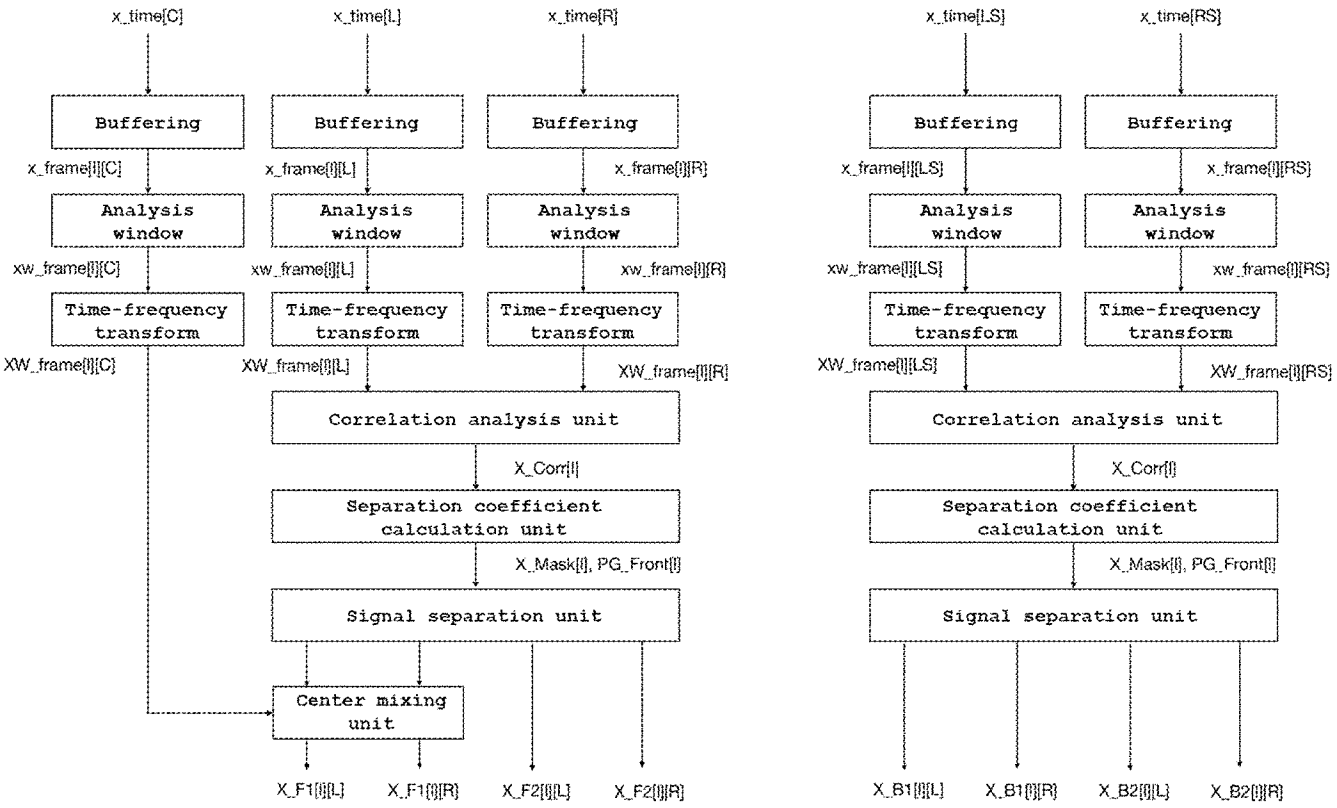
FIG. 17 illustrates an upmixer according to an embodiment of the present disclosure.
Figure 18:
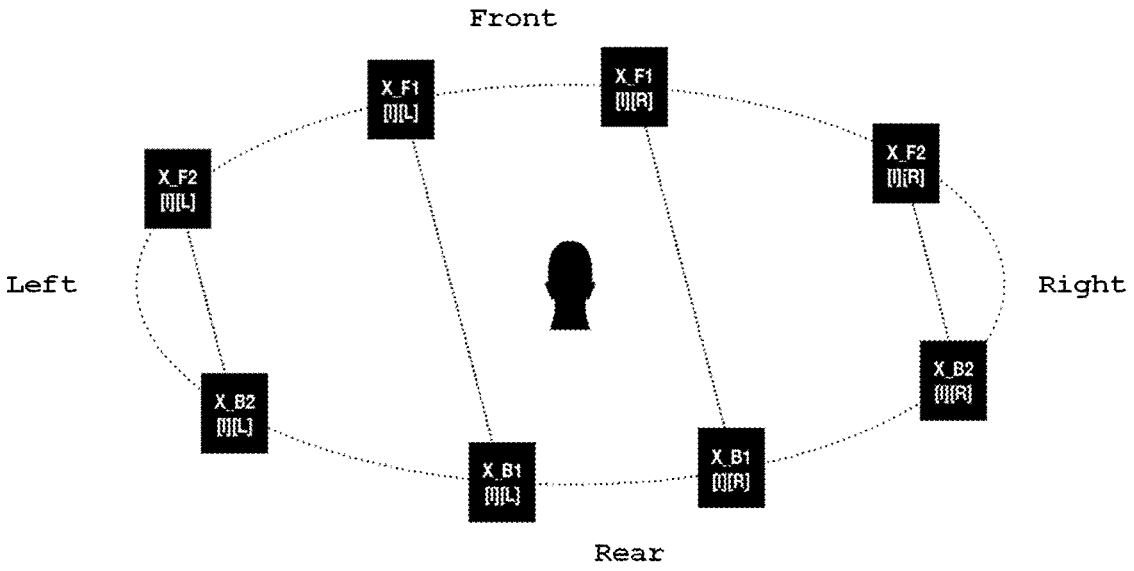
FIG. 18 illustrates a symmetrical layout configuration according to an embodiment of the present disclosure.
Figure 19:
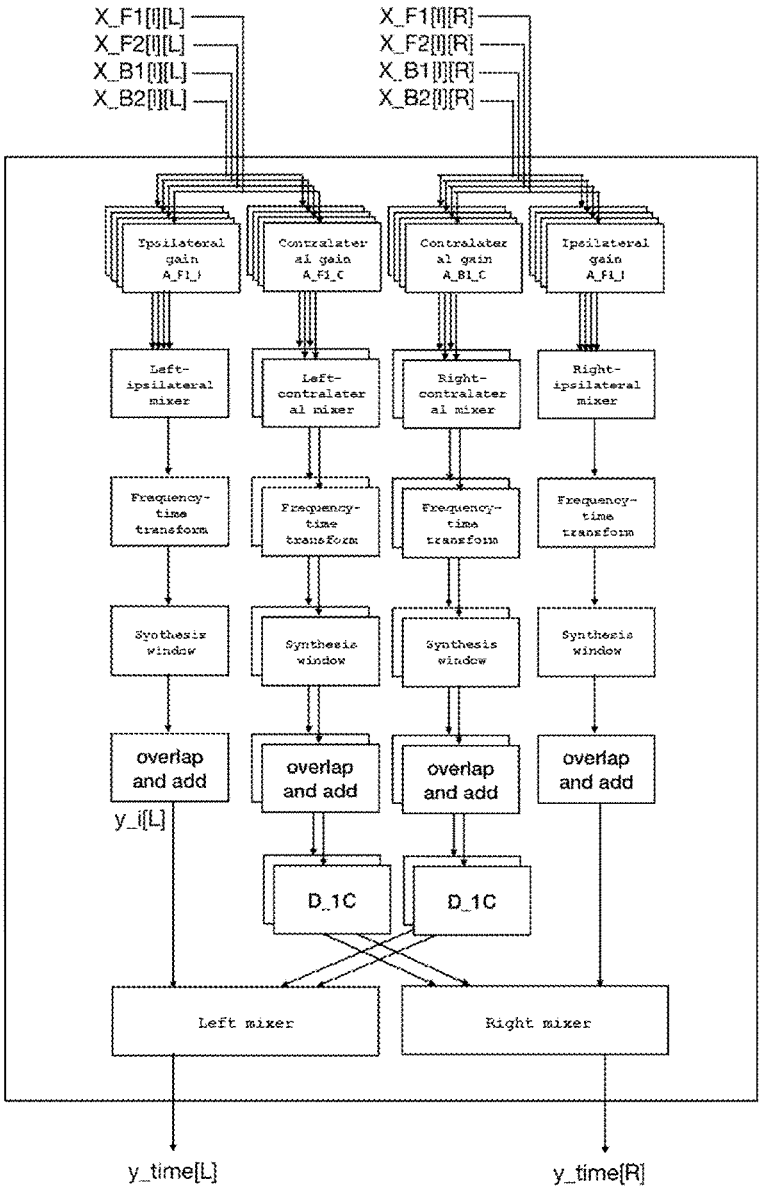
FIG. 19 illustrates a method of binauralizing an input signal according to an embodiment of the present disclosure.

FIG. 17 to FIG. 19 illustrate an embodiment in which the above-described binauralization is applied to upmixing.

FIG. 17 illustrates an upmixer according to an embodiment of the present disclosure.

FIG. 17 illustrates an example of an upmixer for transforming a 5-channel input signal into 4 channels in the front and 4 channels in the rear and generating a total of 8 channel signals. The indexes C, L, R, LS, and RS of the input signals of FIG. 17 indicate center, left, right, left surround, and right surround of a 5.1 channel signal. When the input signal is upmixed, a reverberator may be used to reduce upmixing artifacts.

FIG. 18 illustrates a symmetrical layout configuration according to an embodiment of the present disclosure.

The signal which has been upmixed through the method described above may be configured by a symmetric virtual layout in which X_F1 is located in the front, X_B1 is located in the rear, X_F2[l][L] and X_B2[l][L] are located on the left, and X_F2[l][R] and X_B2[l][R] are located on the right, as shown in FIG. 18.

FIG. 19 illustrates a method of binauralizing an input signal according to an embodiment of the present disclosure.

FIG. 19 is an example of a method of binauralizing a signal corresponding to a symmetric virtual layout as shown in FIG. 18.

All four locations (X_F1[l][L], XF1[l][R], X_B1[l][L], and X_B1[l][R]) corresponding to X_F1 and X_B1 according to FIG. 18 may have the same ITD corresponding to D_1C. All four locations (X_F2[l][L], XF2[l][R], X_B2[l][L], and X_B2[l][R]) based on X_F2 and X_B2 according to FIG. 18 may have the same ITD corresponding to D_2C. For example, ITD may have a value of 1 ms or less.

Referring to FIG. 19, an ipsilateral gain and a contralateral gain, calculated based on the HRIR of a virtual channel, may be applied to frequency signals (e.g., virtual sound sources of speakers existing at locations numbered 1 to 15 of FIG. 17). All ipsilateral frequency signals may be mixed in left ipsilateral and right ipsilateral mixers. In the case of contralateral frequency signals, signals having the same ITD, such as a pair of X_F1 and X_B1 and a pair of X_F2 and X_B2, are mixed by a left-contralateral mixer and a right-contralateral mixer. Thereafter, the mixed signal may be transformed into a time-domain signal through frequency-time transform. A synthesis window and overlap-and-add processing are applied to the transformed signal, and finally, D_1C and D_2C are applied to the contralateral time signal so that an output signal y_time may be generated. According to FIG. 19, six transforms are applied to generate a binaural signal. Therefore, compared to the case in which 18 transforms are required, as in the method shown in FIG. 11, there is an effect that similar rendering is possible through 6 transforms, i.e. the number of transformation processes is reduced by ⅓.

Interactive Binauralization Method for Frequency Signal Input

In addition to a head mounted display (HMD) for virtual reality, recent headphone devices (hereinafter referred to as user devices) may provide information on a user's head orientation by using sensors such as a gyro sensor. Here, the information on the head orientation may be provided through an interface calculated in the form of a yaw, a pitch, a roll, an up vector, and a forward vector. These devices may perform binauralization of the sound source by calculating the relative location of the sound source according to orientation of a user's head. Accordingly, the devices may interact with users to provide improved immersiveness.

Figure 20:
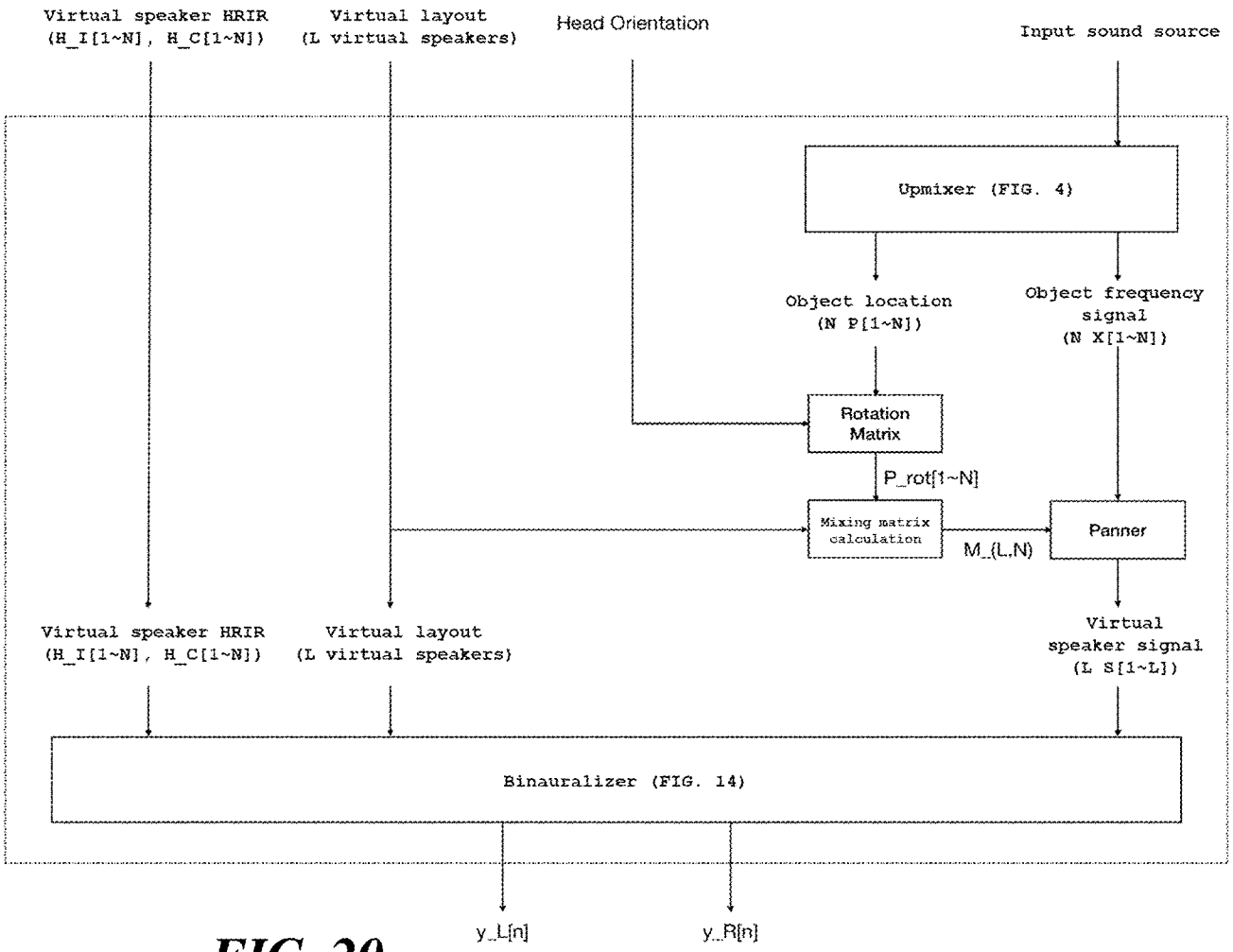
FIG. 20 illustrates a method of performing interactive binauralization corresponding to orientation of a user's head according to an embodiment of the present disclosure.

FIG. 20 illustrates a method of performing interactive binauralization corresponding to orientation of a user's head according to an embodiment of the present disclosure.

Referring to FIG. 20, an example of a process in which a user device performs interactive binauralization corresponding to the user's head orientation is as follows.

i) An upmixer of a user device may receive an input of a general stereo sound source (an input sound source), a head orientation, a virtual speaker layout, and an HRIR of a virtual speaker.

ii) The upmixer of the user device may receive the general stereo sound source, and may extract N-channel frequency signals through the upmixing process described with reference to FIG. 4. In addition, the user device may define the extracted N-channel frequency signals as N object frequency signals. In addition, the N-channel layout may be provided to correspond to the object location.

iii) The user device may calculate N user-centered relative object locations from N object locations and information on the user's head orientation. The n-th object location vector P_n, defined by x, y, z in Cartesian coordinates, may be transformed into the relative object location P_rot_n in the Cartesian coordinates through a dot product with a rotation matrix M_rot based on the user's yaw, pitch, and roll.

iv) A mixing matrix generation unit of the user device may obtain a panning coefficient in a virtual speaker layout configured by L virtual speakers and N object frequency signals, based on the calculated N relative object locations, so as to generate "M", which is a mixing matrix of dimensions L×N.

v) A panner of the user device may generate L virtual speaker signals by multiplying N object signals by a mixing matrix of dimensions L×M.

vi) The binauralizer of the user device may perform binauralization, which has been described with reference to FIG. 14, by using the virtual speaker signal, the virtual speaker layout, and the HRIR of the virtual speaker.

The method of calculating the panning coefficient, which has been defined in iv), may use a method such as constant-power panning or constant-gain panning according to a normalization scheme. In addition, a method such as vector-base amplitude panning may also be used in the way that a predetermined layout is defined.

In consideration that the final output is not connected to a physical loudspeaker but is binauralized according to an embodiment of the present disclosure, the layout configuration may be configured to be optimized for binauralization.

Figure 21:
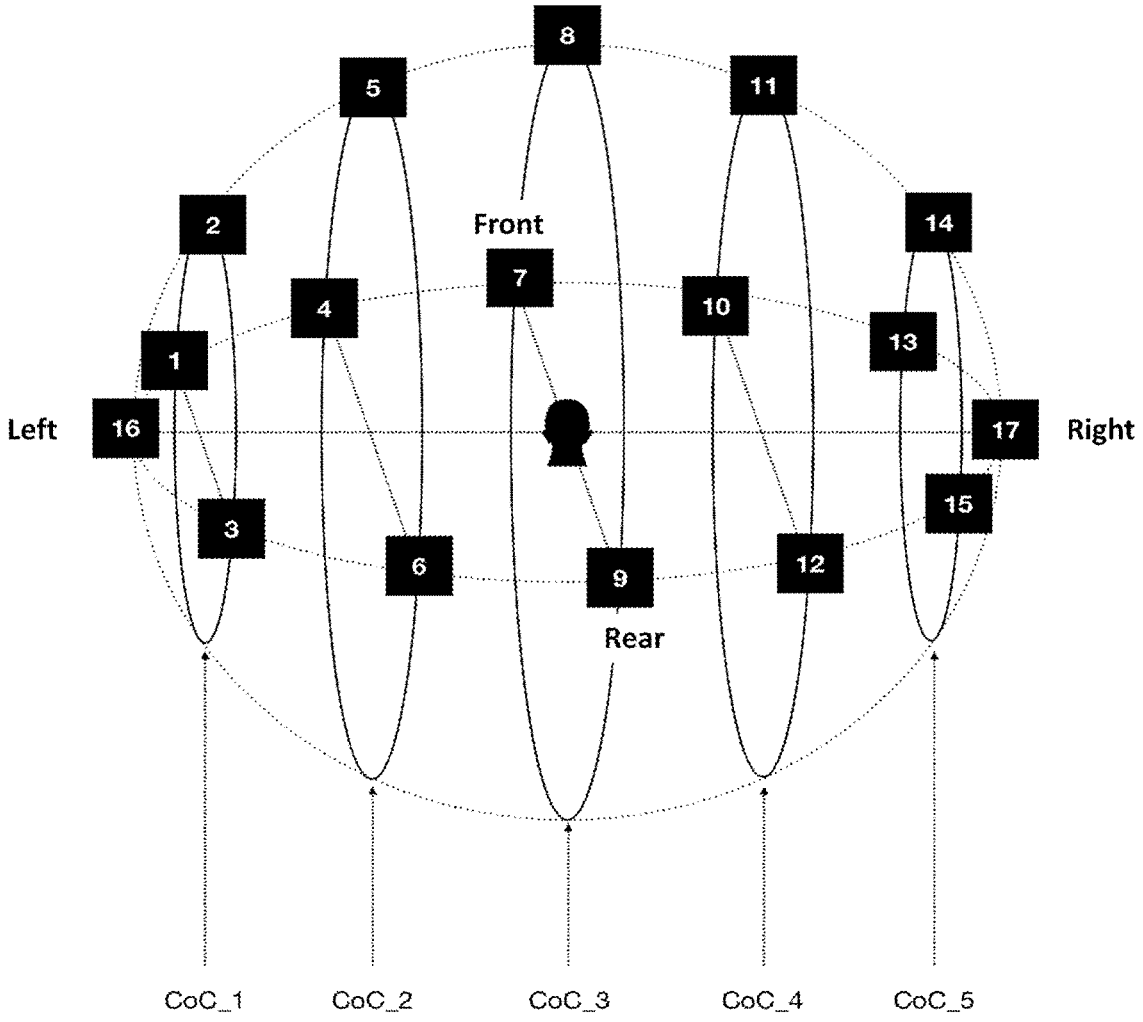
FIG. 21 illustrates a virtual speaker layout configured by a cone of confusion in an interaural polar coordinate (IPC) system according to an embodiment of the present disclosure.

FIG. 21 illustrates a virtual speaker layout configured by a cone of confusion (CoC) in an interaural polar coordinate (IPC) according to an embodiment of the present disclosure.

According to FIG. 21, the virtual speaker layout may include a total of 15 virtual speakers configured by five CoCs, namely CoC_1 to CoC_5. The virtual layout may be configured by a total of 17 speakers including a total of 15 speakers configured by a total of 5 CoCs and left-end and right-end speakers. In this case, panning to the virtual speaker may be performed through two operations to be described later.

According to an embodiment of the present disclosure, the virtual speaker layout may exist in a CoC, and may be configured by three or more CoCs. Here, one of three or more CoCs may be located on a median plane.

A plurality of virtual speakers having the same IPC azimuth angle may exist in one CoC. Meanwhile, when the azimuth angle is +90 degrees or −90 degrees, one CoC may be configured by only one virtual speaker.

Figure 22:
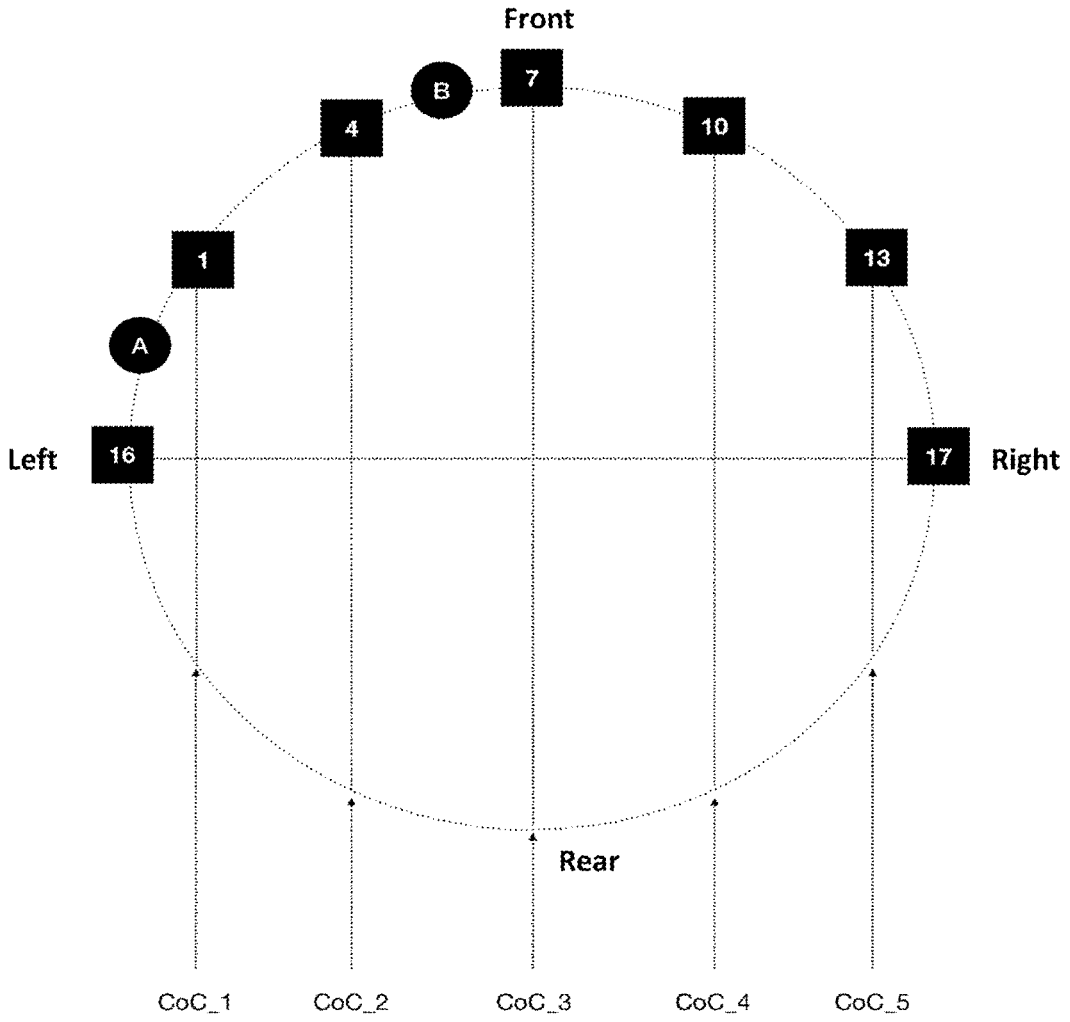
FIG. 22 illustrates a method of panning to a virtual speaker according to an embodiment of the present disclosure.

FIG. 22 illustrates a method of panning to a virtual speaker according to an embodiment of the present disclosure.

Referring to FIG. 22, a method of panning to a virtual speaker will be described.

The first operation of the method of panning to the virtual speaker is to perform two-dimensional panning to 7 virtual speakers corresponding to virtual speakers numbered 1, 4, 7, 10, 13, 16, and 17, using the azimuth information in the IPC as shown in FIG. 22. That is, object A performs panning to virtual speakers numbered 1 and 16 and object B performs panning to virtual speakers numbered 4 and 7. As a specific panning method, a method such as constant-power panning or a constant-gain panning may be used. In addition, a method in the form of normalizing the weighting of sine and cosine to a gain as in <Equation 21> may be used. <Equation 21> is an example of a method of panning object A of FIG. 22. "azi_x" in <Equation 21> denotes the azimuth angle of x, for example, "aziran" in <Equation 21> denotes the azimuth angle of A.

$$P_16_0=\sin((azi_a-azi_1)/(azi_16-azi_1)*pi/2)$$

$$P_CoC1_0=\cos((azi_a-azi_1)/(azi_16-azi_1)*pi/2)$$

$$P_16=P_16_0/(P_16_0+P_CoC1_0)$$

$$P_CoC1=P_CoC1_0/(P_16_0+P_CoC1_0) \quad \text{[Equation 21]}$$

Since object A exists between virtual speakers numbered 1 and 16, a location vector P_16 of the 16th object is calculated. In addition, since object A exists in CoC1, P_CoC1 is calculated.

Figure 23:
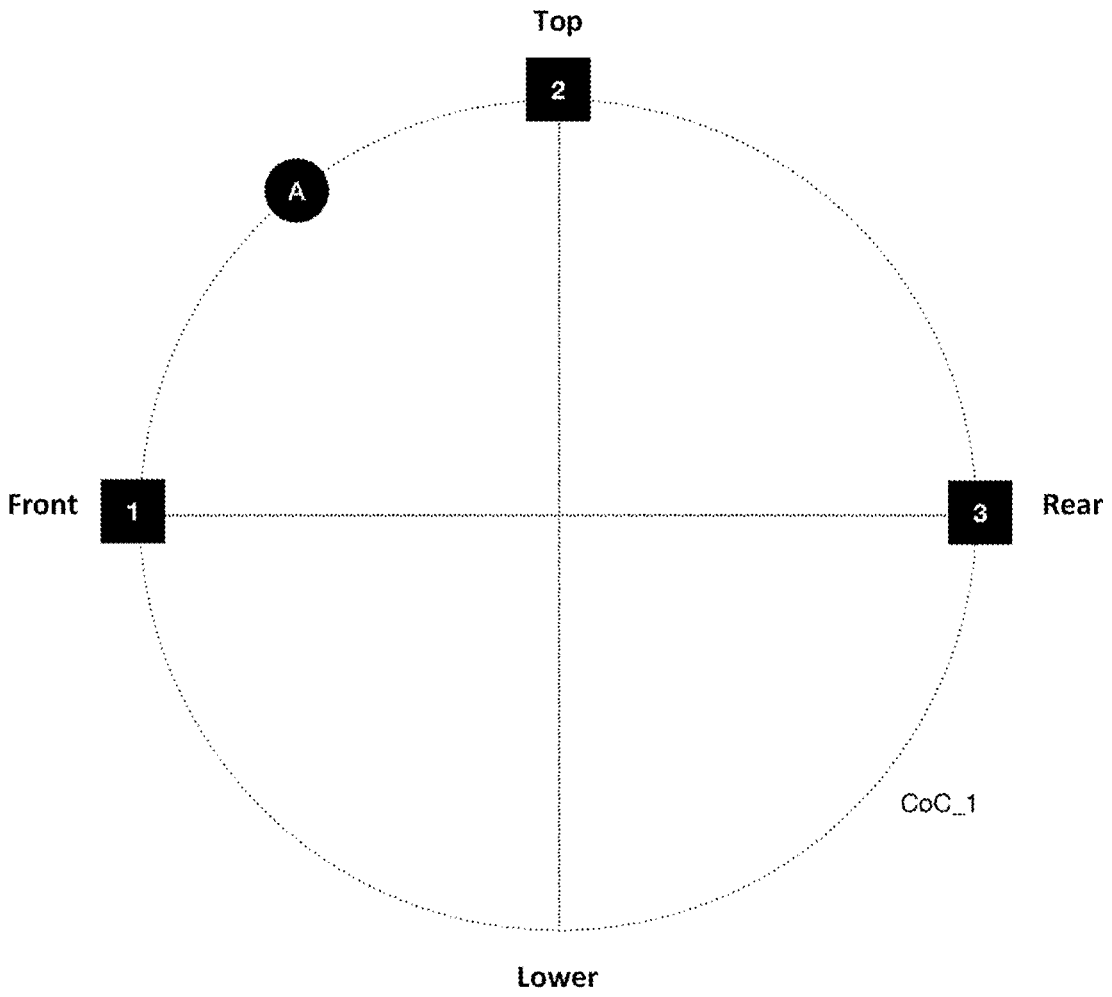
FIG. 23 illustrates a method of panning to a virtual speaker according to another embodiment of the present disclosure.

FIG. 23 illustrates a method of panning to a virtual speaker according to an embodiment of the present disclosure.

The second operation of the method of panning to the virtual speaker is to perform localization of IPC elevation angle by using a virtual speaker located at each CoC.

Referring to FIG. 23, since the component of object A located in CoC_1 is located between virtual speakers numbered 1 and number 7, the object A component may be panned as in <Equation 22>. In <Equation 22>, "ele_x" denotes an elevation angle of x, for example, "ele_a" in <Equation 22> denotes an elevation angle of object A.

$$P_1_0=\cos((ele_a-ele_1)/(ele_7-ele_1)*pi/2)$$

$$P_7_0=\sin((ele_a-ele_1)/(ele_7-ele_1)*pi/2)$$

$$P_1=P_1_0/(P_1_0+P_7_0)*P_CoC1$$

$$P_7=P_7_0/(P_1_0+P_7_0)*P_CoC1 \quad \text{[Equation 22]}$$

Object A may be localized using the panning gains P_1, P_7, and P_16, calculated through <Equation 21> and <Equation 22>.

Figure 24:
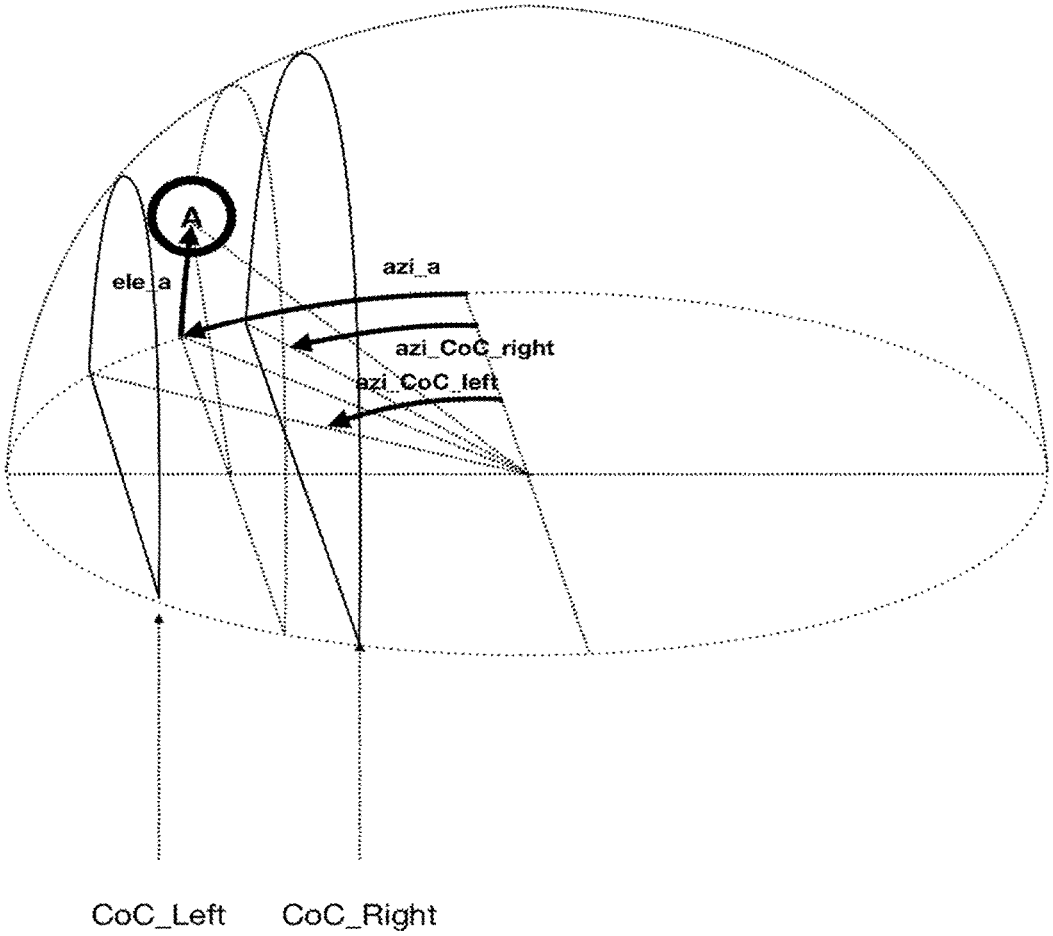
FIG. 24 is a spherical view illustrating panning to a virtual speaker according to an embodiment of the present disclosure.

FIG. 24 illustrates a spherical view for panning to a virtual speaker according to an embodiment of the present disclosure.

Figure 25:
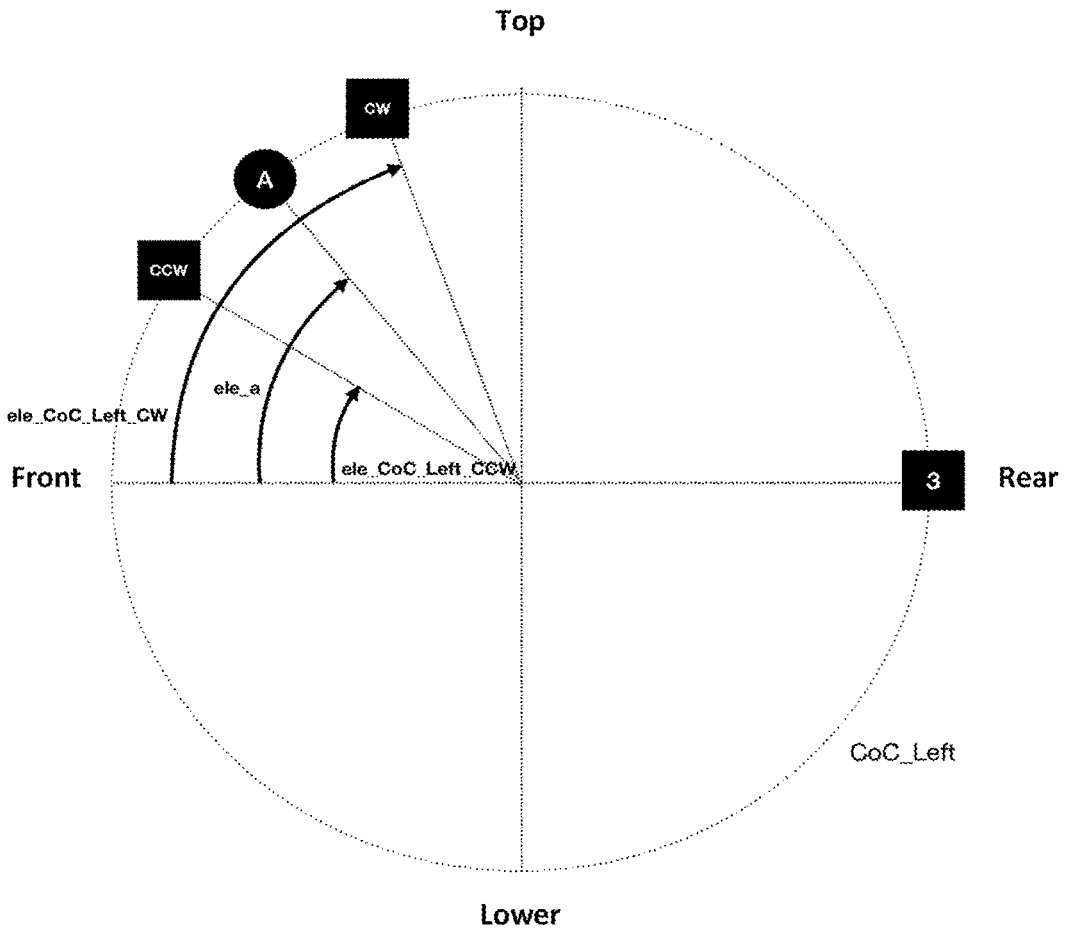
FIG. 25 is a left view illustrating panning to a virtual speaker according to an embodiment of the present disclosure.

FIG. 25 illustrates a left view for panning to a virtual speaker according to an embodiment of the present disclosure.

Hereinafter, referring to FIG. 24 and FIG. 25, a method of panning to a virtual speaker will be generalized and described.

The above-described mixing matrix may be generated through a method described later.

a) A mixing matrix generation unit for generating a mixing matrix of a system for outputting N speaker signals may localize object signals, located at the azimuth angle of azi a and the elevation angle of ele_a in the IPC, in N speaker layouts configured by C CoCs, perform panning to the virtual speaker, and then generate the mixing matrix.

b) In order to perform panning to a virtual speaker, azimuth panning using azimuth information and elevation panning for localizing IPC elevation angle by using a virtual speaker located in a CoC may be performed. Azimuth panning may also be referred to as cone-of-confusion panning.

b-i) Azimuth Panning

The mixing matrix generation unit may select two CoCs, which are closest to the left and right from the azimuth azi a, respectively, among the C CoCs. In addition, the mixing matrix generation unit may calculate panning gains P_CoC_Left and P_CoC_Right between CoCs, with reference to the IPC azimuth azi_CoC_Left of the left CoC "CoC_Left" and the IPC azimuth azi_CoC_Right of the right CoC "CoC_Right" of the selected two CoCs, as in <Equation 23>. The sum of the panning gains P_CoC_Left and P_CoC_Right may be "1". Azimuth panning may also be referred to as horizontal panning.

$$\begin{aligned}
&P_CoC_Left_0 = \cos((azi_a - azi_CoC_Left)/(azi_CoC_Right - azi_CoC_Left)*pi/2) \quad \text{[Equation 23]}\\
&P_CoC_Right_0 = \sin((azi_a - azi_CoC_Left)/(azi_CoC_Right - azi_CoC_Left)*pi/2)\\
&P_CoC_Left = P_CoC_Left_0/(P_CoC_Left_0 + P_CoC_Right_0)\\
&P_CoC_Right = P_CoC_Right_0/(P_CoC_Left_0 + P_CoC_Right_0)
\end{aligned}$$

b-ii) Elevation Panning The mixing matrix generation unit may select two virtual speakers CW and CCW, which are closest in a clockwise or counterclockwise direction from the elevation angle "ele_a", respectively, among virtual speakers existing on CoC_Left. In addition, the mixing matrix generation unit may calculate panning gains P_CoC_Left_CW and P_CoC_Left_CCW, localized between ele_CoC_Left, which is the IPC elevation angle of the CW, and ele_CoC_Left_CCW, which is the IPC elevation angle of the CCW, as in <Equation 24>. In addition, the mixing matrix unit may calculate P_CoC_Right_CW and P_CoC_Right_CCW as in <Equation 25> by using the same method above. The sum of the panning gains P_CoC_Right_CW and P_CoC_Right_CCW may be "1". Elevation panning may be described as vertical panning.

$$P_CoC_Left_CW_0=\sin((ele_a-ele_azi_CoC_Left_CCW)/(ele_azi_CoC_Left_CW-ele_azi_CoC_Left_CCW)*pi/2)$$

$$P_CoC_Left_CCW_0=\cos((ele_a-ele_azi_CoC_Left_CCW)/(ele_azi_CoC_Left_CW-ele_azi_CoC_Left_CCW)*pi/2)$$

$$P_CoC_Left_CW=P_CoC_Left_CW_0/(P_CoC_Left_CW_0+P_CoC_Left_CCW_0)$$

$$P_CoC_Left_CCW=P_CoC_Left_CCW_0/(P_CoC_Left_CW_0P_CoC_Left_CCW_0) \quad \text{[Equation 24]}$$

$$P_CoC_Right_CW_0=\sin((ele_a-ele_azi_CoC_Right_CCW)/(ele_azi_CoC_Right_CW-ele_azi_CoC_Right_CCW)*pi/2)$$

$$P_CoC_Right_CCW_O=\cos((ele_a-ele_azi_CoC_Right_CCW)/(ele_azi_CoC_Right_CW-ele_azi_CoC_Right_CCW)*pi/2)$$

$$P_CoC_Right_CW=P_CoC_Right_CW_0/(P_CoC_Right_CW_0+P_CoC_Right_CCW_0)$$

$$P_CoC_Right_CCW=P_CoC_Right_CCW_0/(P_CoC_Right_CW_0+P_CoC_Right_CCW_0) \quad \text{[Equation 25]}$$

When the indexes of speakers corresponding to P_CoC_Left_CW, P_CoC_Right_CW, P_CoC_Left_CCW, and P_CoC_Right_CCW generated through the above-described process are called a, b, c, and d, respectively, the mixing matrix generation unit may calculate the final panning gain P[a][A] with respect to input object A, as in <Equation 26>.

$$P[a][A]=P_CoC_Left_CW*P_CoC_Left$$

$$P[b][A]=P_CoC_Right_CW*P_CoC_Right$$

$$P[c][A]=P_CoC_Left_CCW*P_CoC_Left$$

$$P[d][A]=P_CoC_Right_CCW*P_CoC_Right$$

$$P[m][A]=0 \text{ for } m \text{ is not in } \{a,b,c,d\} \quad \text{[Equation 26]}$$

In addition, the mixing matrix generation unit may repeat the processes of a) and b) described above to generate the entire mixing matrix M for localizing N objects to L virtual channel speakers, as in <Equation 27>.

$$M = \begin{bmatrix} P[1][1] & P[1][2] & \dots & P[1][N]; \\ P[2][1] & P[2][2] & \dots & P[2][N]; \\ \dots & \dots & \dots & \dots; \\ P[L][1] & P[L][2] & \dots & P[L][N] \end{bmatrix} \quad \text{[Equation 27]}$$

When the mixing matrix is calculated, a panner may generate L virtual speaker signals "S" by using N input signals X[1~N] and the mixing matrix M, as in <Equation 28). A dot function of <Equation 28> denotes a dot product.

$$S=M(\text{dot})X \quad \text{[Equation 28]}$$

The user device (e.g., a headphone) may binauralize an output signal virtual speaker layout, an HRIR corresponding thereto, and a virtual speaker input signal S, and output the same. Here, for the above binauralization, the binauralization method described with reference to FIG. 14 may be used.

A combination of the method for calculating the mixing matrix and localizing the sound image and the method for binauralization, which have been described in the present specification, will be described again below.

i) As in <Equation 23>, a pair of CoCs may be determined by the azimuth angle in the IPC of an object sound source. Here, a horizontal interpolation ratio may be defined as a ratio between P_CoC_Left and P_CoC_Right.

ii) As in <Equation 24> and <Equation 25>, a vertical interpolation ratio of two virtual speakers adjacent to an object sound source may be defined as P_CoC_Right_CW (or P_CoC_Left_CW) or P_CoC_Right_CCW (or P_CoC_Left_CCW), by using the elevation angle in the IPC.

iii) Panning of four virtual sound sources (four virtual speakers adjacent to the object sound source) is calculated through a horizontal interpolation ratio and a vertical interpolation ratio as in <Equation 26>.

iv) Binaural rendering may be performed by multiplying a panning coefficient for one input object (e.g., a sound source) by HRIRs of four virtual sound sources. The above binaural rendering may be the same as synthesizing an interpolated HRIR and then performing binauralization of the interpolated HRIR by multiplying the interpolated HRIR by the object sound source. Here, the interpolated HRIR may be generated by applying the panning gains for the four virtual sound sources, calculated through <Equation 26>, to an HRIR corresponding to each virtual sound source.

<Equation 23>, <Equation 24>, and <Equation 25> for calculating the interpolation coefficient have characteristics of gain normalization rather than power normalization used in general loudspeaker panning. When signals are mixed again due to binauralization, vertical component virtual channel signals corresponding to IPC elevation angles located in the same CoC are added in-phase. Therefore, gain normalization may be performed in consideration of the fact that only constructive interference occurs. Also, even in the case of horizontal signals corresponding to other IPC azimuth angles in the CoC, all ipsilateral components of a direction in which a signal is larger than in the other direction are added in-phase. Accordingly, gain normalization may be performed.

Figure 26:
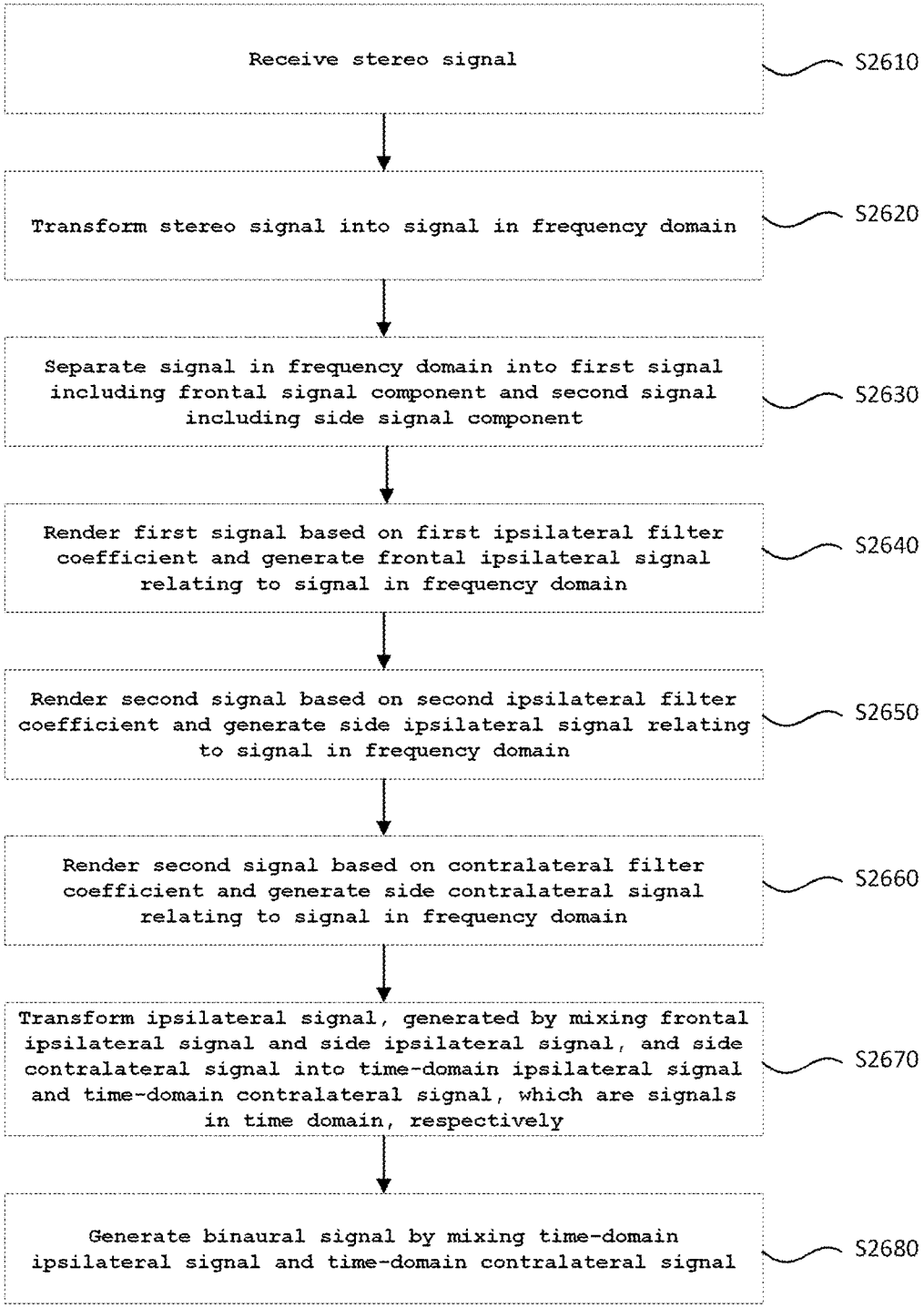
FIG. 26 is a flow chart illustrating generation of a binaural signal according to an embodiment of the present disclosure.

FIG. 26 is a flow chart illustrating generation of a binaural signal according to an embodiment of the present disclosure.

FIG. 26 illustrates a method of generating a binaural signal according to embodiments described above with reference to FIG. 1 to FIG. 25.

In order to generate a binaural signal, the binaural signal generation apparatus may receive a stereo signal and transform the stereo signal into a frequency-domain signal (indicated by reference numerals S2610 and S2620).

The binaural signal generation apparatus may separate the frequency-domain signal into a first signal and a second signal, based on an inter-channel correlation and an inter-channel level difference (ICLD) of the frequency-domain signal (indicated by reference numeral S2630).

Here, the first signal includes a frontal component of the frequency-domain signal, and the second signal includes a side component of the frequency-domain signal.

The binaural signal generation apparatus may render the first signal based on a first ipsilateral filter coefficient, and may generate a frontal ipsilateral signal relating to the frequency-domain signal (indicated by reference numeral S2640). The first ipsilateral filter coefficient may be generated based on an ipsilateral response signal of a first head-related impulse response (HRIR).

The binaural signal generation apparatus may render the second signal based on a second ipsilateral filter coefficient, and may generate a side ipsilateral signal relating to the frequency-domain signal (indicated by reference numeral S2650). The second ipsilateral filter coefficient may be generated based on an ipsilateral response signal of a second HRIR.

The binaural signal generation apparatus may render the second signal based on a contralateral filter coefficient, and may generate a side contralateral signal relating to the frequency-domain signal (indicated by reference numeral S2660). The contralateral filter coefficient may be generated based on a contralateral response signal of the second HRIR.

The binaural signal generation apparatus may transform an ipsilateral signal, generated by mixing the frontal ipsilateral signal and the side ipsilateral signal, and the side contralateral signal into a time-domain ipsilateral signal and a time-domain contralateral signal, which are time-domain signals, respectively (indicated by reference numeral S2670).

The binaural signal generation apparatus may generate a binaural signal by mixing the time-domain ipsilateral signal and the time-domain contralateral signal (indicated by reference numeral S2680).

The binaural signal may be generated in consideration of an interaural time delay (ITD) applied to the time-domain contralateral signal.

The first ipsilateral filter coefficient, the second ipsilateral filter coefficient, and the contralateral filter coefficient may be real numbers.

The sum of a left-channel signal of the first signal and a left-channel signal of the second signal may be the same as a left-channel signal of the stereo signal.

The sum of a right-channel signal of the first signal and a right-channel signal of the second signal may be the same as a right-channel signal of the stereo signal.

The energy of the left-channel signal of the first signal and energy of the right-channel signal of the first signal may be the same as each other.

A contralateral characteristic of the HRIR in consideration of ITD is applied to an ipsilateral characteristic of the HRIR.

The ITD may be 1 ms or less.

A phase of the left-channel signal of the first signal may be the same as a phase of the left-channel signal of the frontal ipsilateral signal. A phase of the right-channel signal of the first signal is the same as a phase of the right-channel signal of the frontal ipsilateral signal. In addition, a phase of the left-channel signal of the second signal, a phase of a left-side signal of the side ipsilateral signal, and a phase of a left-side signal of the side contralateral signal are the same. A phase of a right-channel signal of the second signal, a phase of a right-side signal of the side ipsilateral signal, and a phase of a right-side signal of the side contralateral signal are the same.

Operation S2670 may include: transforming a left ipsilateral signal and a right ipsilateral signal, generated by mixing the frontal ipsilateral signal and the side ipsilateral signal for each of left and right channels, into a time-domain left ipsilateral signal and a time-domain right ipsilateral signal, which are time-domain signals, respectively; and transforming the side contralateral signal into a left-side contralateral signal and a right-side contralateral signal, which are time-domain signals, for each of left and right channels.

Here, the binaural signal may be generated by mixing the time-domain left ipsilateral signal and the time domain left-side contralateral signal, and by mixing the time-domain right ipsilateral signal and the time-domain right-side contralateral signal.

In order to perform the above-described binaural signal generation method, a binaural signal generation apparatus may include: an input terminal configured to receive a stereo signal; and a processor including a renderer.

The present disclosure has been described above with reference to specific embodiments. However, various modifications are possible by a person skilled in the art without departing from the scope of the present disclosure. That is, although the present disclosure has been described with respect to an embodiment of binaural rendering of an audio signal, the present disclosure can be equally applied and extended to various multimedia signals including video signals as well as audio signals. Therefore, matters that can be easily inferred by a person skilled in the technical field to which the present disclosure belongs from the detailed description and embodiment of the present disclosure are to be interpreted as belonging to the scope of the present disclosure.

The embodiments of the present disclosure described above can be implemented through various means. For example, embodiments of the present disclosure may be implemented by hardware, firmware, software, a combination thereof, and the like.

In the case of implementation by hardware, a method according to embodiments of the present disclosure may be implemented by one or more of application specific integrated circuits (ASICs), digital signal processors (DSPs), digital signal processing devices (DSPDs), programmable logic devices (PLDs), field programmable gate arrays (FPGAs), processors, controllers, microcontrollers, microprocessors, and the like.

In the case of implementation by firmware or software, a method according to the embodiments of the present disclosure may be implemented in the form of a module, a procedure, a function, and the like that performs the functions or operations described above. Software code may be stored in a memory and be executed by a processor. The memory may be located inside or outside the processor, and may exchange data with the processor through various commonly known means.

Some embodiments may also be implemented in the form of a recording medium including computer-executable instructions, such as a program module executed by a computer. Such a computer-readable medium may be a predetermined available medium accessible by a computer, and may include all volatile and nonvolatile media and removable and non-removable media. Further, the computer-readable medium may include a computer storage medium and a communication medium. The computer storage medium includes all volatile and non-volatile media and removable and non-removable media, which have been implemented by a predetermined method or technology, for storing information such as computer-readable instructions, data structures, program modules, and other data. The communication medium typically include a computer-readable command, a data structure, a program module, other data of a modulated data signal, or another transmission mechanism, as well as predetermined information transmission media.

The present disclosure has been made for illustrative purposes, and a person skilled in the art to which the present disclosure pertains will be able to understand that the present disclosure can be easily modified into other specific forms without changing the technical spirit or essential features of the present disclosure. Therefore, it should be understood that the embodiments described above are not intended to limit the scope of the present disclosure. For example, each element described as a single type may be implemented in a distributed manner, and similarly, elements described as being distributed may also be implemented in a combined form.

The invention claimed is:

1. An audio signal processing method comprising:

receiving a stereo signal;

transforming the stereo signal into a frequency-domain signal;

separating the frequency-domain signal into a first signal and a second signal based on an inter-channel correlation and an inter-channel level difference (ICLD) of the frequency-domain signal, wherein the first signal includes a frontal component of the frequency-domain signal, and the second signal includes a side component of the frequency-domain signal;

rendering the first signal based on a first ipsilateral filter coefficient and generating a frontal ipsilateral signal relating to the frequency-domain signal, wherein the first ipsilateral filter coefficient is generated based on an ipsilateral response signal of a first head-related impulse response (HRIR);

rendering the second signal based on a second ipsilateral filter coefficient and generating a side ipsilateral signal relating to the frequency-domain signal, wherein the second ipsilateral filter coefficient is generated based on an ipsilateral response signal of a second HRIR;

rendering the second signal based on a contralateral filter coefficient and generating a side contralateral signal relating to the frequency-domain signal, wherein the contralateral filter coefficient is generated based on a contralateral response signal of the second HRIR;

transforming an ipsilateral signal, generated by mixing the frontal ipsilateral signal and the side ipsilateral signal, and the side contralateral signal into a time-domain ipsilateral signal and a time-domain contralateral signal, which are time-domain signals, respectively; and generating a binaural signal by mixing the time-domain ipsilateral signal and the time-domain contralateral signal, wherein the binaural signal is generated in consideration of an interaural time delay (ITD) applied to the time-domain contralateral signal, and wherein the first ipsilateral filter coefficient, the second ipsilateral filter coefficient, and the contralateral filter coefficient are real numbers.

2. The method of claim 1, wherein a sum of a left-channel signal of the first signal and a left-channel signal of the second signal is the same as a left-channel signal of the stereo signal.

3. The method of claim 1, wherein a sum of a right-channel signal of the first signal and a right-channel signal of the second signal is the same as a right-channel signal of the stereo signal.

4. The method of claim 1, wherein energy of a left-channel signal of the first signal and energy of a right-channel signal of the first signal are the same as each other.

5. The method of claim 1, wherein a contralateral characteristic of the HRIR in consideration of ITD is applied to an ipsilateral characteristic of the HRIR.

6. The method of claim 1, wherein the ITD is 1 ms or less.

7. The method of claim 1, wherein a phase of a left-channel signal of the first signal is the same as a phase of the left-channel signal of the frontal ipsilateral signal, wherein a phase of a right-channel signal of the first signal is the same as a phase of a right-channel signal of the frontal ipsilateral signal, wherein a phase of a left-channel signal of the second signal, a phase of a left-side signal of the side ipsilateral signal, and a phase of a left-side signal of the side contralateral signal are the same, and wherein a phase of a right-channel signal of the second signal, a phase of a right-side signal of the side ipsilateral signal, and a phase of a right-side signal of the side contralateral signal are the same.

8. The method of claim 1, wherein the transforming of the ipsilateral signal, generated by mixing the frontal ipsilateral signal and the side ipsilateral signal, and the side contralateral signal into a time-domain ipsilateral signal and a time-domain contralateral signal, which are time-domain signals, respectively, comprises:

transforming a left ipsilateral signal and a right ipsilateral signal, generated by mixing a frontal ipsilateral signal and a side ipsilateral signal for each of left and right channels, into a time-domain left ipsilateral signal and a time-domain right ipsilateral signal, which are time-domain signals, respectively; and transforming the side contralateral signal into a left-side contralateral signal and a right-side contralateral signal, which are time-domain signals, for each of left and right channels, wherein the binaural signal is generated by mixing the time-domain left ipsilateral signal and a time-domain left-side contralateral signal and mixing the time-domain right ipsilateral signal and a time-domain right-side contralateral signal.

9. An audio signal processing apparatus comprising:

an input terminal configured to receive a stereo signal; and a processor including a renderer, wherein the processor is configured to:

transform the stereo signal into a frequency-domain signal;

separate the frequency-domain signal into a first signal and a second signal based on an inter-channel correlation and an inter-channel level difference (ICLD) of the frequency-domain signal, wherein the first signal includes a frontal component of the frequency-domain signal, and the second signal includes a side component of the frequency-domain signal;

render the first signal based on a first ipsilateral filter coefficient and generate a frontal ipsilateral signal relating to the frequency-domain signal, wherein the first ipsilateral filter coefficient is generated based on an ipsilateral response signal of a first head-related impulse response (HRIR);

render the second signal based on a second ipsilateral filter coefficient and generate a side ipsilateral signal relating to the frequency-domain signal, wherein the second ipsilateral filter coefficient is generated based on an ipsilateral response signal of a second HRIR;

render the second signal based on a contralateral filter coefficient and generate a side contralateral signal relating to the frequency-domain signal, wherein the contralateral filter coefficient is generated based on a contralateral response signal of the second HRIR;

transform an ipsilateral signal, generated by mixing the frontal ipsilateral signal and the side ipsilateral signal, and the side contralateral signal into a time-domain ipsilateral signal and a time-domain contralateral signal, which are time-domain signals, respectively; and generate a binaural signal by mixing the time-domain ipsilateral signal and the time-domain contralateral signal, wherein the binaural signal is generated in consideration of an interaural time delay (ITD) applied to the time-domain contralateral signal, and wherein the first ipsilateral filter coefficient, the second ipsilateral filter coefficient, and the contralateral filter coefficient are real numbers.

10. The apparatus of claim 9, wherein a sum of a left-channel signal of the first signal and a left-channel signal of the second signal is the same as a left-channel signal of the stereo signal.

11. The apparatus of claim 9, wherein a sum of a right-channel signal of the first signal and a right-channel signal of the second signal is the same as a right-channel signal of the stereo signal.

12. The apparatus of claim 9, wherein energy of the left-channel signal of the first signal and energy of the right-channel signal of the first signal are the same as each other.

13. The apparatus of claim 9, wherein a contralateral characteristic of the HRIR in consideration of ITD is applied to an ipsilateral characteristic of the HRIR.

14. The apparatus of claim 9, wherein the ITD is 1 ms or less.

15. The apparatus of claim 9, wherein a phase of the left-channel signal of the first signal is the same as a phase of the left-channel signal of the frontal ipsilateral signal, wherein a phase of the right-channel signal of the first signal is the same as a phase of the right-channel signal of the frontal ipsilateral signal, wherein a phase of the left-channel signal of the second signal, a phase of a left-side signal of the side ipsilateral signal, and a phase of a left-side signal of the contralateral signal are the same, and wherein a phase of a right-channel signal of the second signal, a phase of a right-side signal of the side ipsilateral signal, and a phase of a right-side signal of the side contralateral signal are the same.

16. The apparatus of claim 9, wherein the transforming, by the processor, of the ipsilateral signal, generated by mixing the frontal ipsilateral signal and the side ipsilateral signal, and the side contralateral signal into a time-domain ipsilateral signal and a time-domain contralateral signal, which are time-domain signals, respectively, comprises:

transforming a left ipsilateral signal and a right ipsilateral signal, generated by mixing the frontal ipsilateral signal and the side ipsilateral signal for each of left and right channels, into a time-domain left ipsilateral signal and a time-domain right ipsilateral signal, which are time-domain signals, respectively; and transforming the side contralateral signal into a left-side contralateral signal and a right-side contralateral signal, which are time-domain signals, for each of left and right channels, wherein the binaural signal is generated by mixing the time-domain left ipsilateral signal and a time-domain left-side contralateral signal and mixing the time-domain right ipsilateral signal and a time-domain right-side contralateral signal.

* * * * *